US010976060B2

(12) United States Patent
Hatanaka et al.

(10) Patent No.: US 10,976,060 B2
(45) Date of Patent: Apr. 13, 2021

(54) HEAT PUMP HOT WATER SUPPLY APPARATUS

(71) Applicant: Mitsubishi Electric Corporation, Tokyo (JP)

(72) Inventors: Kensaku Hatanaka, Tokyo (JP); Toru Koide, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 254 days.

(21) Appl. No.: 15/774,626

(22) PCT Filed: Jan. 14, 2016

(86) PCT No.: PCT/JP2016/050906
§ 371 (c)(1),
(2) Date: May 9, 2018

(87) PCT Pub. No.: WO2017/122303
PCT Pub. Date: Jul. 20, 2017

(65) Prior Publication Data

US 2018/0328596 A1 Nov. 15, 2018

(51) Int. Cl.
*F24D 17/02* (2006.01)
*F24D 19/10* (2006.01)
(Continued)

(52) U.S. Cl.
CPC ..... *F24D 17/02* (2013.01); *F24D 19/1033* (2013.01); *F24D 19/1054* (2013.01);
(Continued)

(58) Field of Classification Search
CPC ..... F24H 1/18; F24H 4/04; F24D 19/1033; F24D 17/02; F24D 19/1054; F24D 3/18
(Continued)

(56) References Cited

U.S. PATENT DOCUMENTS

2011/0139259 A1* 6/2011 Nagata ..... F24D 19/1069 137/1

FOREIGN PATENT DOCUMENTS

JP 2004-324912 A 11/2004
JP 2006-023064 A 1/2006
(Continued)

OTHER PUBLICATIONS

International Search Report of the International Searching Authority dated Apr. 12, 2016 for the corresponding international application No. PCT/JP2016/050906 (and English translation).
(Continued)

*Primary Examiner* — Kenneth J Hansen
*Assistant Examiner* — John E Bargero
(74) *Attorney, Agent, or Firm* — Posz Law Group, PLC

(57) ABSTRACT

Provided is a heat pump hot water supply apparatus configured to directly supply water heated by a gas cooler to a utilization side. The heat pump hot water supply apparatus is configured to execute operation modes including a first operation mode and a second operation mode. The first operation mode includes causing the water heated by the gas cooler to return to a water tank as intermediate-temperature water. The second operation mode is an operation mode to be performed after the first operation mode, and includes mixing the water heated by the gas cooler and the intermediate-temperature water in the water tank, and directly supplying the mixed water to the utilization side.

10 Claims, 8 Drawing Sheets

(51) Int. Cl.
*F24H 4/04* (2006.01)
*F24H 1/18* (2006.01)
*F24D 3/18* (2006.01)

(52) U.S. Cl.
CPC ..... *F24H 1/18* (2013.01); *F24H 4/04* (2013.01); *F24D 3/18* (2013.01)

(58) Field of Classification Search
USPC ..... 237/2 B
See application file for complete search history.

(56) References Cited

FOREIGN PATENT DOCUMENTS

| | | | |
|---|---|---|---|
| JP | 2007-147246 | A | 6/2007 |
| JP | 2007-232345 | A | 9/2007 |
| JP | 2012-042071 | A | 3/2012 |
| JP | 2015-078773 | A | 4/2015 |

OTHER PUBLICATIONS

Extended EP Search Report dated Nov. 27, 2018 issued in corresponding EP patent application No. 16884906.5.

* cited by examiner

HEAT PUMP HOT WATER SUPPLY APPARATUS

CROSS REFERENCE TO RELATED APPLICATION

This application is a U.S. national stage application of PCT/JP2016/050906 filed on Jan. 14, 2016, the contents of which are incorporated herein by reference.

TECHNICAL FIELD

The present invention relates to a heat pump hot water supply apparatus using a heat pump cycle as a heat source configured to heat water, and to a heat pump hot water supply apparatus configured to generate hot water by heating water through use of the heat pump cycle and directly supply the generated hot water to a utilization side.

BACKGROUND ART

There has been known a heat pump hot water supply apparatus configured to generate hot water by heating water through use of a gas cooler of a heat pump cycle, store the hot water in a water tank, and supply the hot water stored in the water tank to a utilization side. Further, as a related-art heat pump hot water supply apparatus, there has also been proposed a heat pump hot water supply apparatus configured to directly supply the hot water generated by the heat pump cycle to the utilization side (see, for example, Patent Literature 1).

The heat pump hot water supply apparatus described in Patent Literature 1 is configured to execute a hot water storage operation mode and a hot water direct supply operation mode. The hot water storage operation mode is a mode of storing the hot water generated by the heat pump cycle in the water tank, and the hot water direct supply operation mode is a mode of directly supplying the hot water generated by the heat pump cycle to a bath that is the utilization side to fill the bath with the hot water. In the hot water direct supply operation mode, immediately after activation of the heat pump cycle, the heat pump hot water supply apparatus described in Patent Literature 1 directly supplies the water heated by the gas cooler of the heat pump cycle to the bath to fill the bath with the hot water. Further, the heat pump hot water supply apparatus described in Patent Literature 1 is constructed such that, when a temperature of the hot water in the bath is lower than a set temperature after completion of the filling of the bath with the hot water, the hot water in the bath is reheated using the hot water stored in the water tank.

When the water is heated by the gas cooler of the heat pump cycle to generate the hot water to be stored in the water tank, to prevent growth of bacteria such as *Legionella* in the water tank, it is necessary to generate hot water having the high temperature (for example, 65 degrees Celsius or more). In contrast, when the water is heated by the gas cooler of the heat pump cycle to generate the hot water to be directly supplied, a hot water temperature in this case can be set lower than a hot water temperature during the hot water storage operation. For example, when a set temperature of the hot water in the bath is set to 40 degrees Celsius, a temperature of the hot water to be generated by the heat pump cycle can be set to around 40 degrees Celsius. As a feature of the heat pump, as the temperature of the hot water to be generated is lower, a coefficient of performance (hereinafter referred to as COP) of the heat pump cycle is improved. In the heat pump hot water supply apparatus described in Patent Literature 1, the hot water generated by the heat pump cycle is directly supplied to the bath to fill the bath with the hot water, thereby improving COP of the heat pump cycle.

CITATION LIST

Patent Literature

Patent Literature 1: Japanese Unexamined Patent Application Publication No. 2015-78773

SUMMARY OF INVENTION

Technical Problem

The water stored in the water tank has such a temperature gradient that the temperature is lowered from an upper portion to a lower portion. In the following, description is made such that the water stored in the water tank is divided into three temperature regions for convenience of the description. Specifically, water having a high temperature stored on an upper side in the water tank is referred to as high-temperature water. Water having a low temperature stored on a lower side in the water tank is referred to as low-temperature water. Water located between the high-temperature water and the low-temperature water in the water tank is referred to as intermediate-temperature water.

The heat pump cycle requires a certain time period to stabilize an operation from the activation, that is, to be brought into a state in which the water can be heated to a desired temperature by the gas cooler. In the hot water direct supply operation mode, immediately after the activation of the heat pump cycle, the heat pump hot water supply apparatus described in Patent Literature 1 directly supplies the water heated by the gas cooler of the heat pump cycle to the bath to fill the bath with the hot water. For this reason, in the heat pump hot water supply apparatus described in Patent Literature 1, at an early stage of the hot water direct supply operation mode, water having a low temperature that is not heated up to the desired temperature is supplied to the bath. Consequently, the heat pump hot water supply apparatus described in Patent Literature 1 has a problem in that the temperature of the hot water in the bath is lower than the set temperature at the completion of the filling of the bath with the hot water.

Further, when the temperature of the hot water in the bath is lower than the set temperature after the completion of the filling of the bath with the hot water, the heat pump hot water supply apparatus described in Patent Literature 1 reheats the hot water in the bath up to the set temperature using the hot water stored in the water tank. In the reheating operation, the high-temperature water stored in the water tank and the hot water in the bath are caused to flow into a heat exchanger, and the hot water flowing into the heat exchanger from the inside of the bath is heated by the high-temperature water. Then, when the high-temperature water heats the hot water flowing into the heat exchanger from the inside of the bath, the high-temperature water is decreased in temperature to turn into intermediate-temperature water, and is caused to return to the water tank. That is, through the reheating operation, the amount of the intermediate-temperature water in the water tank is increased. In other words, the temperature of the water in the water tank is decreased. To prevent growth of bacteria such as *Legionella* in the water tank due to decrease in temperature of the water in the water tank, it is necessary to heat the intermediate-temperature water in the water tank into high-temperature water by the heat pump cycle during a next hot water storage operation. Consequently, the heat pump hot water supply apparatus described in Patent Literature 1 has a problem in that the COP of the heat pump cycle is reduced when the reheating is required as a result of the hot water direct supply operation.

The present invention has been made to solve the problems described above, and has an object to obtain a heat pump hot water supply apparatus capable of preventing a temperature of hot water in a bath from being lower than a set temperature when the hot water is filled in a hot water direct supply operation mode, and improving a COP of the heat pump cycle.

Solution to Problem

According to one embodiment of the present invention, there is provided a heat pump hot water supply apparatus, including a heat pump cycle including a gas cooler configured to heat water, a water tank including an inflow port for water, a first outflow port for water, the first outflow port being provided above the inflow port, and a second outflow port for water, the second outflow port being provided above the inflow port and below the first outflow port, a flow switching portion configured to switch between the water tank and a utilization side to which the water heated by the gas cooler is allowed to flow, and a mixing portion provided between the flow switching portion and the utilization side, and configured to mix water supplied from the flow switching portion and water supplied from at least one of the first outflow port and the second outflow port, and allow the mixed water to flow to the utilization side. The heat pump hot water supply apparatus is configured to execute operation modes including a first operation mode and a second operation mode to be performed after the first operation mode. The first operation mode includes causing, by the flow switching portion, the water heated by the gas cooler to return to the water tank. The second operation mode includes causing, by the flow switching portion, the water heated by the gas cooler to flow to the mixing portion, mixing, by the mixing portion, the water supplied from the flow switching portion and at least the water supplied from the second outflow port, and allowing the mixed water to flow to the utilization side.

Advantageous Effects of Invention

The heat pump hot water supply apparatus according to one embodiment of the present invention is constructed as described above. Thus, when the hot water is supplied from the mixing portion to a bath, which is an example of the utilization side, to fill the bath with the hot water, a temperature of the hot water in the bath can be prevented from being lower than the set temperature when the hot water is filled in the hot water direct supply operation mode, thereby being capable of improving the COP of the heat pump cycle.

Specifically, the heat pump hot water supply apparatus according to one embodiment of the present invention operates in the first operation mode before the second operation mode, which is the hot water direct supply operation mode. Further, in the first operation mode, the water heated by the gas cooler is caused to return to the water tank. Consequently, in the heat pump hot water supply apparatus according to one embodiment of the present invention, when the hot water is supplied from the mixing portion to the bath to fill the bath with the hot water, low-temperature water generated immediately after the activation of the heat pump cycle can be prevented from being supplied to the bath. Further, in the heat pump hot water supply apparatus according to one embodiment of the present invention, the water heated by the gas cooler is mixed with at least the water supplied from the second outflow port of the water tank by the mixing portion, and the mixed water is caused to flow to the bath. That is, in the heat pump hot water supply apparatus according to one embodiment of the present invention, the water heated by the gas cooler can be mixed with the intermediate-temperature water in the water tank, and the mixed water can be supplied to the bath. Consequently, in the heat pump hot water supply apparatus according to one embodiment of the present invention, when the bath is filled with the hot water in the second operation mode, which is the hot water direct supply operation mode, the temperature of the hot water in the bath can be prevented from being lower than the set temperature.

Further, in the heat pump hot water supply apparatus according to one embodiment of the present invention, as described above, the water heated by the gas cooler can be mixed with the intermediate-temperature water in the water tank, and the mixed water can be supplied to the bath. For this reason, in the heat pump hot water supply apparatus according to one embodiment of the present invention, increase of the amount of the intermediate-temperature water in the water tank can be prevented, thereby being also capable of improving the COP of the heat pump cycle during the hot water storage operation. Consequently, the heat pump hot water supply apparatus according to one embodiment of the present invention can improve the COP of the heat pump cycle as compared to the related art.

DESCRIPTION OF EMBODIMENTS

Embodiment 1

Figure 1:
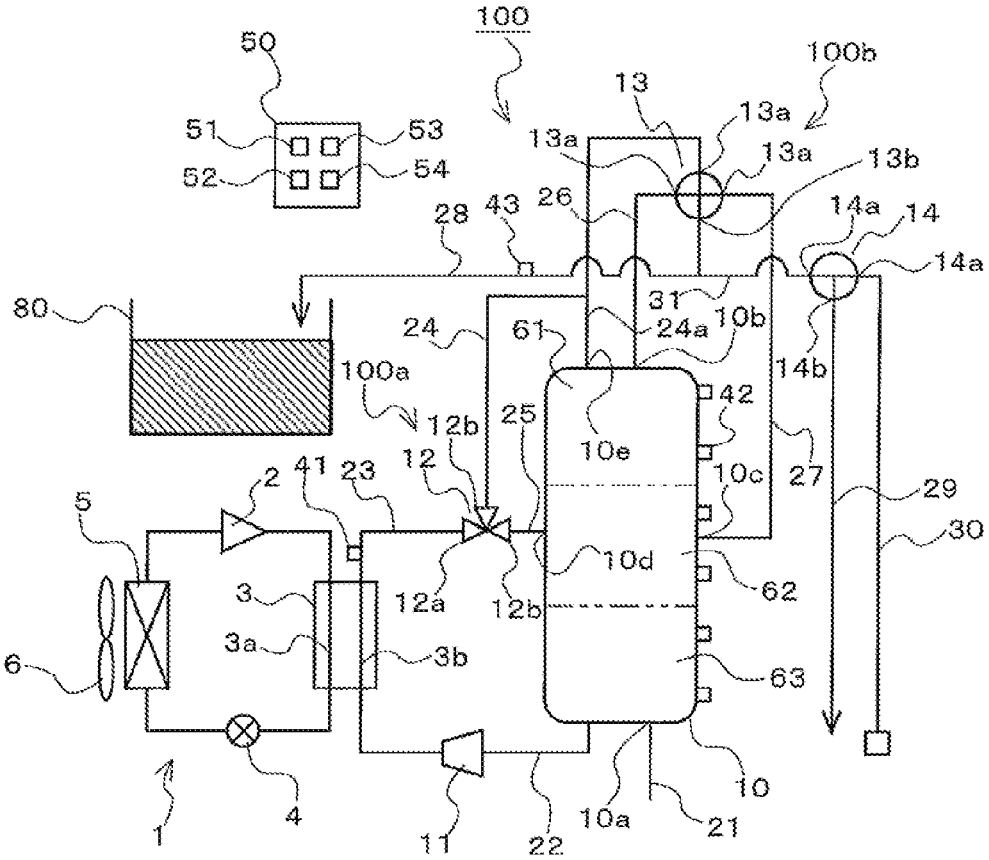
FIG. 1 is an overall configuration diagram of a heat pump hot water supply apparatus according to Embodiment 1 of the present invention.

FIG. 1 is an overall configuration diagram of a heat pump hot water supply apparatus according to Embodiment 1 of the present invention.

In the following, with reference to FIG. 1, an overall configuration of a heat pump hot water supply apparatus 100 according to Embodiment 1 is described. A temperature of water stored in a water tank 10 of the heat pump hot water supply apparatus 100 has such a temperature gradient that the temperature is lowered from an upper portion to a lower portion. Consequently, in each of embodiments including Embodiment 1, when matters regarding the temperature of the water stored in the water tank 10 are described, description is made such that the water stored in the water tank 10 is divided into three temperature regions in some cases for convenience of the description. In this case, water having a high temperature stored on an upper side in the water tank 10 is referred to as high-temperature water 61. Water having a low-temperature stored on a lower side in the water tank 10 is referred to as low-temperature water 63. Water located between the high-temperature water 61 and the low-temperature water 63 in the water tank 10 is referred to as intermediate-temperature water 62.

The heat pump hot water supply apparatus 100 according to Embodiment 1 includes a heat pump cycle 1 and the water tank 10. The heat pump cycle 1 includes a gas cooler 3 configured to heat water. The water tank 10 is configured to store the water heated in the heat pump cycle 1, that is, hot water. Further, the heat pump hot water supply apparatus 100 also includes a flow switching portion 100*a* and a mixing portion 100*b* forming flow passages through which the water flows. The flow switching portion 100*a* is configured to switch between the water tank 10 and a utilization side to which the water heated by the gas cooler 3 of the heat pump cycle 1 is allowed to flow. The mixing portion 100*b* is provided between the flow switching portion 100*a* and the utilization side, and is configured to mix water supplied from the flow switching portion 100*a* and water supplied from at least one of an outflow port 10*b* and an outflow port 10*c* of the water tank 10, and to allow the mixed water to flow to the utilization side. The utilization side is, for example, a bath 80.

Specifically, the heat pump cycle 1 is constructed by annularly connecting a compressor 2, the gas cooler 3, an expansion valve 4, and an evaporator 5 to one another by refrigerant pipes.

The compressor 2 is configured to compress low-temperature and low-pressure refrigerant into high-temperature and high-pressure refrigerant. The gas cooler 3 includes a refrigerant flow passage 3*a* through which the refrigerant flows, and a water flow passage 3*b* through which water that is an object to be heated flows. The refrigerant flow passage 3*a* is connected to a discharge side of the compressor 2, and the high-temperature and high-pressure refrigerant compressed by the compressor 2 flows through the refrigerant flow passage 3*a*. The water stored in the lower portion of the water tank 10 flows through the water flow passage 3*b*. That is, the water flowing through the water flow passage 3*b* is heated by the high-temperature and high-pressure refrigerant flowing through the refrigerant flow passage 3*a*. The expansion valve 4 is configured to expand the refrigerant flowing out from the refrigerant flow passage 3*a* of the gas cooler 3 into low-temperature and low-pressure refrigerant. The evaporator 5 is, for example, an air heat exchanger configured to exchange heat between air and the refrigerant. The refrigerant flowing out from the expansion valve 4 receives heat from the air in the evaporator 5 to be evaporated. In Embodiment 1, to promote the evaporation of the refrigerant by the evaporator 5, a fan 6 configured to supply the air to the evaporator 5 is provided in the vicinity of the evaporator 5. The refrigerant flowing out from the evaporator 5 is sucked into the compressor 2, and is compressed again.

The water tank 10 includes an inflow port 10*a* for water, the two outflow ports 10*b* and 10*c* for water, and two return ports 10*d* and 10*e*. A water supply pipe 21 described later is connected to the inflow port 10*a*, and the inflow port 10*a* is provided, for example, in the lower portion of the water tank 10. A connection pipe 26 described later is connected to the outflow port 10*b*, and the outflow port 10*b* is provided above the inflow port 10*a*. The outflow port 10*b* is provided, for example, in the upper portion of the water tank 10. A connection pipe 27 described later is connected to the outflow port 10*c*, and the outflow port 10*c* is provided above the inflow port 10*a* and below the outflow port 10*b*. The outflow port 10*c* is provided, for example, in a substantially center part of the water tank 10 in an up-and-down direction of the water tank 10. A connection pipe 24*a* described later is connected to the return port 10*e*, and the return port 10*e* is provided, for example, in the upper portion of the water tank 10. A branch pipe 25 described later is connected to the return port 10*d*, and the return port 10*d* is provided above the inflow port 10*a* and below the outflow port 10*b*. The return port 10*d* is provided, for example, in the substantially center part of the water tank 10 in the up-and-down direction.

In this case, the outflow port 10*b* corresponds to a first outflow port of the present invention. The outflow port 10*c* corresponds to a second outflow port of the present invention. The return port 10*d* corresponds to a first return port of the present invention.

As described above, a first end portion of the water supply pipe 21 is connected to the inflow port 10*a* of the water tank 10. The water supply pipe 21 supplies water such as city water to the lower portion of the water tank 10. Further, a first end portion of an inflow pipe 22 is also connected to the lower portion of the water tank 10. A second end portion of the inflow pipe 22 is connected to an inflow port of the water flow passage 3*b* of the gas cooler 3. A first end portion of the outflow pipe 23 is connected to an outflow port of the water flow passage 3*b* of the gas cooler 3. A second end portion of the outflow pipe 23 is connected to an inflow port 12*a* of a flow switching device 12. Further, a pump 11 is provided on the inflow pipe 22. The pump 11 is configured to supply the water in the water tank 10 to the water flow passage 3*b* of the gas cooler 3 through the inflow pipe 22. The pump 11 may be provided on the outflow pipe 23. Even when the pump 11 is provided on the outflow pipe 23, the water in the water tank 10 can be caused to flow to the water flow passage 3*b* of the gas cooler 3 through the inflow pipe 22. That is, the inflow pipe 22 and the pump 11 construct a supply portion configured to supply the water in the water tank 10 to the water flow passage 3*b* of the gas cooler 3.

The flow switching device 12 includes the inflow port 12*a* and a plurality of outflow ports 12*b*, and is configured to switch between any one of the outflow ports 12*b* to which the water flowing in through the inflow port 12*a* is allowed to flow. The flow switching device 12 in Embodiment 1 includes the two outflow ports 12*b*, and hence is constructed by a three-way valve. A branch pipe is connected to each one of the outflow ports 12*b*. Specifically, a first end portion of a branch pipe 24 is connected to one of the outflow ports 12*b*. A first end portion of the branch pipe 25 is connected to the other one of the outflow ports 12*b*. The flow switching device 12 is not limited to the three-way valve, and, for example, may be constructed by combining two-way valves.

A second end portion of the above-mentioned branch pipe 24 is connected to the connection pipe 24*a*. A first end portion of the connection pipe 24*a* is connected to the return port 10*e* of the water tank 10, and a second end portion of the connection pipe 24*a* is connected to one of inflow ports 13*a* of a mixing device 13 described later. In this case, the mixing device 13 described later is provided between the connection pipe 24*a* and the bath 80, which is the utilization side. Consequently, through switching of flow passages of the flow switching device 12, the water flowing in through the inflow port 12*a* can be switched to be allowed to flow to the water tank 10 or the utilization side. That is, the outflow pipe 23, the flow switching device 12, the branch pipe 25, the branch pipe 24, and the connection pipe 24*a* construct the flow switching portion 100*a*.

Under a state in which the flow passages of the flow switching device 12 are switched so that the outflow pipe 23 and the branch pipe 24 are communicated with each other, when the mixing device 13 described later blocks a flow passage of the connection pipe 24*a*, the water flowing through the connection pipe 24*a* is caused to return to the water tank 10.

As a pipe having a first end portion connected to the upper portion of the water tank 10, and a second end portion connected to another one of the inflow ports 13*a* of the mixing device 13 described later, as described above, there is also given the connection pipe 26. The connection pipe 26 is a pipe for supplying the high-temperature water 61 in the water tank 10 to the mixing device 13. Further, a second end portion of the above-mentioned branch pipe 25 is connected to the return port 10*d* of the water tank 10.

The mixing device 13 includes an outflow port 13*b* and the plurality of inflow ports 13*a*, and is configured to mix flows of the water flowing in through the inflow ports 13*a* with each other, and to cause the mixed water to flow out through the outflow port 13*b*. In the case of Embodiment 1, the mixing device 13 includes the three inflow ports 13*a*. The mixing device 13 can also cause the water flowing in through any one of the inflow ports 13*a* to flow out through the outflow port 13*b*. Further, the mixing device 13 can also block flow passages between all of the inflow ports 13*a* and the outflow port 13*b* to prevent the water from flowing out through the outflow port 13*b*. In Embodiment 1, the mixing device 13 is constructed by one mixing valve. However, the mixing device 13 may be constructed by a plurality of mixing valves each including two or smaller number of inflow ports.

As described above, the second end portion of the connection pipe 26 is connected to the one of the inflow ports 13*a*. Further, as described above, the second end portion of the connection pipe 24*a* is also connected to the another one of the inflow ports 13*a*. Moreover, a second end portion of the connection pipe 27 is connected to the remaining one of the inflow ports 13*a*. The connection pipe 27 is a pipe for supplying the intermediate-temperature water 62 in the water tank 10 to the mixing device 13. Further, a first end portion of a hot water supply pipe 28 is connected to the outflow port 13*b* of the mixing device 13. A second end portion of the hot water supply pipe 28 is connected to the bath 80, which is the utilization side. In other words, the outflow port 13*b* of the mixing device 13 is connected to the bath 80, which is the utilization side, through the hot water supply pipe 28. In the heat pump hot water supply apparatus 100 according to Embodiment 1, the utilization side to which the water is supplied in a hot water direct supply mode described later is not limited to the bath 80, and may be, for example, a faucet or a shower head.

That is, through the control of the mixing device 13, the water supplied from the flow switching portion 100*a* can be mixed with the water supplied from at least one of the outflow port 10*b* and the outflow port 10*c* of the water tank 10, and the mixed water can be supplied to the bath 80, which is the utilization side. That is, the mixing device 13, the connection pipe 26, the connection pipe 27, and the hot water supply pipe 28 construct the mixing portion 100*b*.

Further, the heat pump hot water supply apparatus 100 according to Embodiment 1 also includes a mixing device 14, a hot water supply pipe 29, a water supply pipe 30, and a connection pipe 31 so that hot water can be supplied to destinations other than the bath 80.

The mixing device 14 includes an outflow port 14*b* and a plurality of inflow ports 14*a*, and is configured to mix flows of the water flowing in through the inflow ports 14*a* with each other, and to cause the mixed water to flow out through the outflow port 14*b*. In the case of Embodiment 1, the mixing device 14 includes the two inflow ports 14*a*. The mixing device 14 can also cause the water flowing in through any one of the inflow ports 14*a* to flow out through the outflow port 14*b*. Further, the mixing device 14 can also block flow passages between all of the inflow ports 14*a* and the outflow port 14*b* to prevent the water from flowing out through the outflow port 14*b*. In Embodiment 1, the mixing device 13 is constructed by one mixing valve. However, the mixing device 13 may be constructed by a plurality of mixing valves.

The connection pipe 31 has a first end portion connected to the hot water supply pipe 28, and a second end portion connected to one of the inflow ports 14*a* of the mixing device 14. The connection pipe 31 supplies the water flowing into the hot water supply pipe 28 from the mixing device 13 to the mixing device 14. The water supply pipe 30 has a first end portion connected to the other one of the inflow ports 14*a* of the mixing device 14. The water supply pipe 30 supplies water such as city water to the mixing device 14. The hot water supply pipe 29 has a first end portion connected to the outflow port 14*b* of the mixing device 14, and a second end portion connected to a utilization side (for example, a shower head) (not shown).

When the number of the utilization sides is one, it is not particularly necessary to provide the mixing device 14, the hot water supply pipe 29, the water supply pipe 30, and the connection pipe 31.

Further, the heat pump hot water supply apparatus 100 includes temperature sensors and a controller 50 configured to control drive devices such as the flow switching device 12 and the mixing device 13 on the basis of, for example, measurement values of the temperature sensors.

Specifically, in the heat pump hot water supply apparatus 100, a temperature sensor 41, which is, for example, a thermistor, is provided on the outflow pipe 23. The temperature sensor 41 is configured to measure a temperature of water heated by the gas cooler 3 and flowing into the outflow pipe 23 to flow through the outflow pipe 23. Further, a plurality of temperature sensors 42 are provided on a side surface portion of the water tank 10 and are arranged in a direction from an upper side to a lower side. Each of the temperature sensors 42 is, for example, a thermistor, and is configured to measure a temperature of the water in the water tank 10 in the vicinity of a position at which each of the temperature sensors 42 is installed. Further, a temperature sensor 43, which is, for example, a thermistor, is provided on the hot water supply pipe 28. The temperature sensor 43 is configured to measure a temperature of water flowing out through the outflow port 13*b* of the mixing device 13 to flow through the hot water supply pipe 28, that is, hot water. In other words, the temperature sensor 43 is configured to measure a temperature of water to be supplied to the bath 80, that is, hot water.

In this case, the temperature sensor 41 corresponds to a first temperature measurement device of the present invention.

The controller 50 is constructed by dedicated hardware or a central processing unit (CPU) (which may also be referred to as a processing device, an arithmetic device, a microprocessor, a microcomputer, or a processor) configured to execute a program stored in a memory.

When the controller 50 is constructed by the dedicated hardware, the controller 50 corresponds to, for example, a single circuit, a composite circuit, an application specific integrated circuit (ASIC), a field-programmable gate array (FPGA), or a combination of these circuits. The functional sections implemented by the controller 50 may be each achieved by individual pieces of hardware, or a single piece of hardware may be used to achieve each of the functional sections.

When the controller 50 is constructed by the CPU, each function executed by the controller 50 is achieved by software, firmware, or a combination of software and firmware. The software or the firmware is described as a program and is stored in a memory. The CPU is configured to read out and execute the program stored in the memory, to thereby achieve the functions of the controller 50. The memory is, for example, a RAM, a ROM, a flash memory, an EPROM, an EEPROM, or other types of non-volatile or volatile semiconductor memory.

A part of the function of the controller 50 may be achieved by the dedicated hardware, and another part of the function of the controller 50 may be achieved by software or firmware.

The controller 50 of Embodiment 1 includes, as functional sections, a storage section 51, a switching section 52, a computing section 53, and a control section 54. The storage section 51 is configured to store a set temperature of the water to be supplied to the bath 80, that is, the water flowing out from the mixing portion 100*b*. Further, the storage section 51 is configured to store a value used when, for example, the control section 54 controls an object to be controlled and a mathematical formula and a table used by the computing section 53 for computing. The switching section 52 is configured to switch an operation mode of the heat pump hot water supply apparatus 100 on the basis of, for example, a measurement value of the temperature sensor 41 and a command from a remote controller (not shown).

The computing section 53 is configured to calculate a heat storage amount in the water tank 10 on the basis of measurement values of the temperature sensors 42. Further, the computing section 53 is configured to determine a temperature of the intermediate-temperature water 62 flowing out from the water tank 10 to the connection pipe 27, that is, a temperature of the water flowing through the connection pipe 27 on the basis of the measurement values of the temperature sensors 42. That is, in Embodiment 1, the temperature sensors 42 and the computing section 53 correspond to a second temperature measurement device of the present invention. As the second temperature measurement device, a temperature sensor, which is, for example, a thermistor, may be provided on the connection pipe 27. Further, the computing section 53 is also configured to calculate an opening degree of each of the inflow ports of the mixing devices 13 and 14. That is, the computing section 53 is configured to calculate, when water having a desired temperature is to be caused to flow out through the outflow port of each of the mixing devices 13 and 14, a degree to which each of the inflow ports and the outflow port are required to be communicated with each other. In other words, the computing section 53 is configured to calculate a mixing ratio of flows of water flowing into each of the mixing devices 13 and 14 from different flow passages. The control section 54 is configured to control, for example, the flow passages of the flow switching device 12, the mixing ratio of each of the mixing devices 13 and 14, and rotation frequencies of the pump 11 and the compressor 2.

[Description of Operation]

Similarly to heat pump hot water supply apparatuses in the related art, the heat pump hot water supply apparatus 100 according to Embodiment 1 is configured to execute a hot water storage operation mode of generating the hot water by heating the water through use of the gas cooler 3 of the heat pump cycle 1, and storing the hot water in the water tank 10. Further, the heat pump hot water supply apparatus 100 according to Embodiment 1 is configured to execute a hot water direct supply operation mode of generating the hot water by heating the water through use of the gas cooler 3 of the heat pump cycle 1, and directly supplying the hot water to the bath 80, which is the utilization side.

Figure 2:
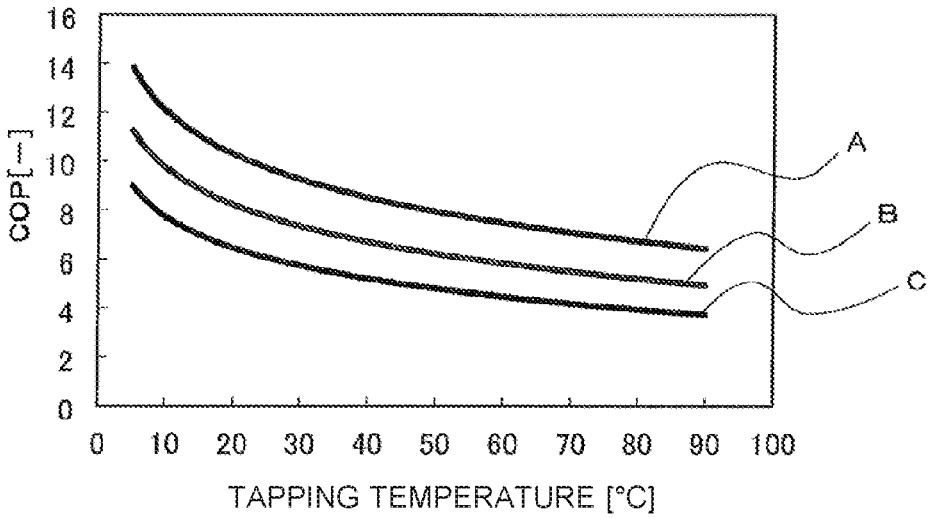
FIG. 2 is a graph for showing a relationship between a tapping temperature of a heat pump cycle and a COP in the heat pump hot water supply apparatus according to Embodiment 1 of the present invention.

FIG. 2 is a graph for showing a relationship between a tapping temperature of the heat pump cycle and a COP in the heat pump hot water supply apparatus according to Embodiment 1 of the present invention.

The tapping temperature represented by the horizontal axis in FIG. 2 indicates a temperature of the water heated by the gas cooler 3, that is, a temperature of the water flowing through the outflow pipe 23. The COP represented by the vertical axis in FIG. 2 indicates a coefficient of performance (hereinafter referred to as COP) of the heat pump cycle 1. Further, the curved line A shown in FIG. 2 indicates the characteristic in a case in which the heat pump cycle 1 is operated at a heating capacity of 2 kW. The curved line B shown in FIG. 2 indicates the characteristic in a case in which the heat pump cycle 1 is operated at a heating capacity of 4 kW. The curved line C shown in FIG. 2 indicates the characteristic in a case in which the heat pump cycle 1 is operated at a heating capacity of 6 kW.

As shown in FIG. 2, it is found that, in the heat pump cycle 1, the COP is improved as the tapping temperature of the gas cooler 3 is decreased, and that the COP is improved as the heating capacity is decreased.

In the case of the hot water storage operation, to prevent growth of bacteria such as *Legionella* in the water tank 10, it is necessary to generate hot water having a high temperature (for example, 65 degrees Celsius or more) by the gas cooler 3. That is, it is necessary to set a tapping temperature of the gas cooler 3 to be a high temperature (for example, 65 degrees Celsius or more). In contrast, in the case of the hot water direct supply operation, a tapping temperature of the gas cooler 3 can be set lower than the tapping temperature during the hot water storage operation. For example, when a set temperature of the water to be supplied to the bath 80 is set to 40 degrees Celsius, the tapping temperature of the gas cooler 3 can be set to around 40 degrees Celsius. Consequently, through the hot water direct supply operation, the COP of the heat pump cycle 1 can be improved. It is particularly effective to perform the hot water direct supply operation to fill the bath 80 with the hot water, which requires a large amount of hot water to be supplied.

In the following, the details of each of the operation modes of the heat pump hot water supply apparatus 100 according to Embodiment 1 are described.

[Hot Water Storage Operation Mode]

Figure 3:
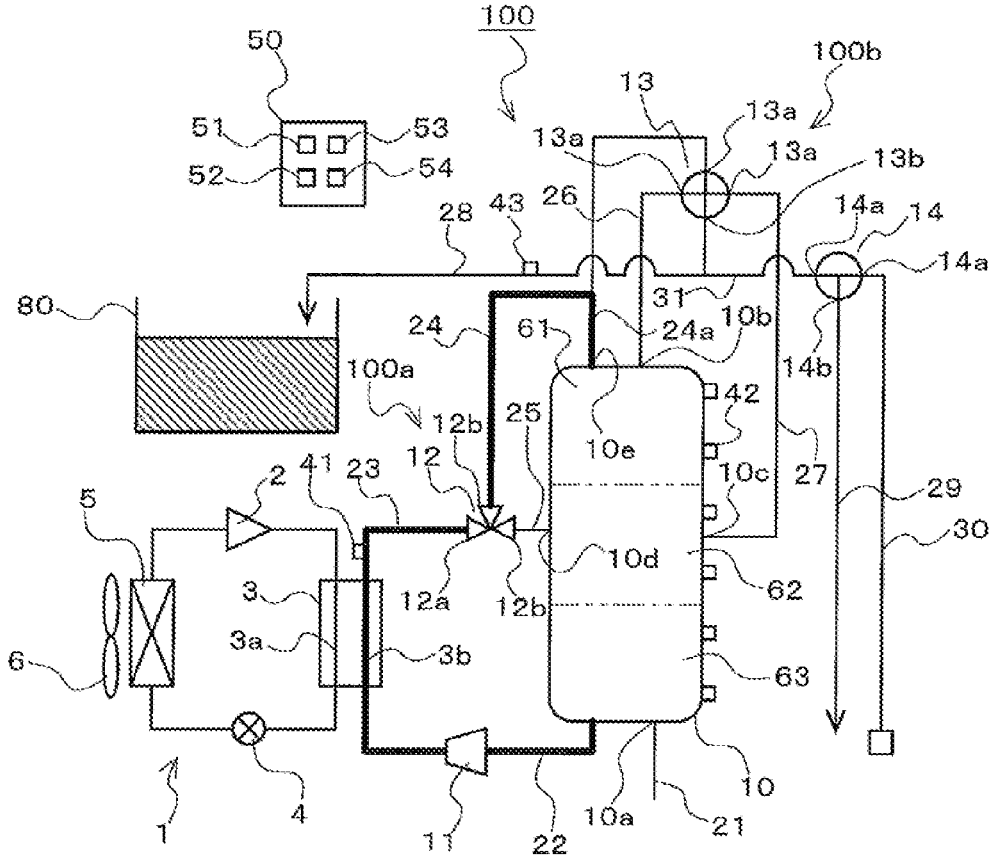
FIG. 3 is a diagram for illustrating an operation of a hot water storage operation mode of the heat pump hot water supply apparatus according to Embodiment 1 of the present invention.

FIG. 3 is a diagram for illustrating an operation of the hot water storage operation mode of the heat pump hot water supply apparatus according to Embodiment 1 of the present invention.

The hot water storage operation mode of Embodiment 1 is an operation of heating the water flowing into the water flow passage 3*b* of the gas cooler 3 from the water tank 10 through pipe 22, and causing the heated water to return to the water tank 10 through the outflow pipe 23, the flow switching device 12, the branch pipe 24, and the connection pipe 24*a*.

Specifically, when the hot water storage operation is started, the control section 54 controls the flow switching portion 100*a* and the mixing portion 100*b* as follows. That is, the control section 54 switches the flow passages of the flow switching device 12 so that the water flowing in through the inflow port 12*a* flows out through the outflow port 12*b* connected to the branch pipe 24, that is, so that the outflow pipe 23 and the branch pipe 24 are communicated with each other. Further, the control section 54 switches the flow passages of the mixing device 13 so that the flow passage between the inflow port 13*a* connected to the connection pipe 24*a* and the outflow port 13*b* is blocked, that is, so that the water flowing through the connection pipe 24*a* flows to the water tank 10 without flowing out from the mixing device 13. Then, the control section 54 activates the heat pump cycle 1 and the pump 11 to start the hot water storage operation.

When the heat pump cycle 1 is activated, that is, when the compressor 2 is activated, the high-temperature and high-pressure gas refrigerant compressed by the compressor 2 flows into the refrigerant flow passage 3*a* of the gas cooler 3. The high-temperature and high-pressure gas refrigerant flowing into the refrigerant flow passage 3*a* heats the water flowing through the water flow passage 3*b* to be condensed into high-pressure liquid refrigerant, and flows out from the refrigerant flow passage 3*a*. The high-pressure liquid refrigerant flowing out from the refrigerant flow passage 3*a* of the gas cooler 3 is reduced in pressure by the expansion valve 4 into low-temperature and low-pressure two-phase gas-liquid refrigerant, and flows into the evaporator 5. The low-temperature and low-pressure two-phase gas-liquid refrigerant flowing into the evaporator 5 removes heat from the air supplied by the fan 6 to be evaporated into low-pressure gas refrigerant, and flows out from the evaporator 5. The low-pressure gas refrigerant flowing out from the evaporator 5 is sucked into the compressor 2 and is compressed again. In this case, the control section 54 controls the rotation frequency of the compressor 2, an opening degree of the expansion valve 4, and a rotation frequency of the fan 6 so that a condensing temperature of the refrigerant becomes equal to a target temperature. The target value of the condensing temperature is a value higher by a predefined temperature than a target value of the tapping temperature of the gas cooler 3 during the hot water storage operation. The target value of the condensing temperature and the target value of the tapping temperature of the gas cooler 3 during the hot water storage operation are stored in the storage section 51. To prevent growth of bacteria such as *Legionella* in the water tank 10, the target value of the tapping temperature of the gas cooler 3 during the hot water storage operation is a value that is a high temperature (for example, 65 degrees Celsius or more).

Meanwhile, when the pump 11 is activated, the water at the lower portion of the water tank 10, that is, the low-temperature water 63 passes through the inflow pipe 22 to flow into the water flow passage 3*b* of the gas cooler 3. The water flowing into the water flow passage 3*b* of the gas cooler 3 is heated by the refrigerant passing through the refrigerant flow passage 3*a*, and flows into the outflow pipe 23. At this time, the control section 54 controls the rotation frequency of the pump 11 so that the tapping temperature of the gas cooler 3 becomes equal to the target value of the tapping temperature of the gas cooler 3 during the hot water storage operation. In other words, the control section 54 controls the rotation frequency of the pump 11 so that the temperature of the water flowing into the outflow pipe 23, that is, the measurement value of the temperature sensor 41 becomes equal to the target value of the tapping temperature of the gas cooler 3 during the hot water storage operation.

The water flowing into the outflow pipe 23 turns into the high-temperature water 61 by being heated by the gas cooler 3. The high-temperature water 61 passes through the flow switching device 12, the branch pipe 24, and the connection pipe 24*a* to flow into the upper portion of the water tank 10.

[Hot Water Direct Supply Operation Preparation Mode and Hot Water Direct Supply Operation Mode]

Figure 4:
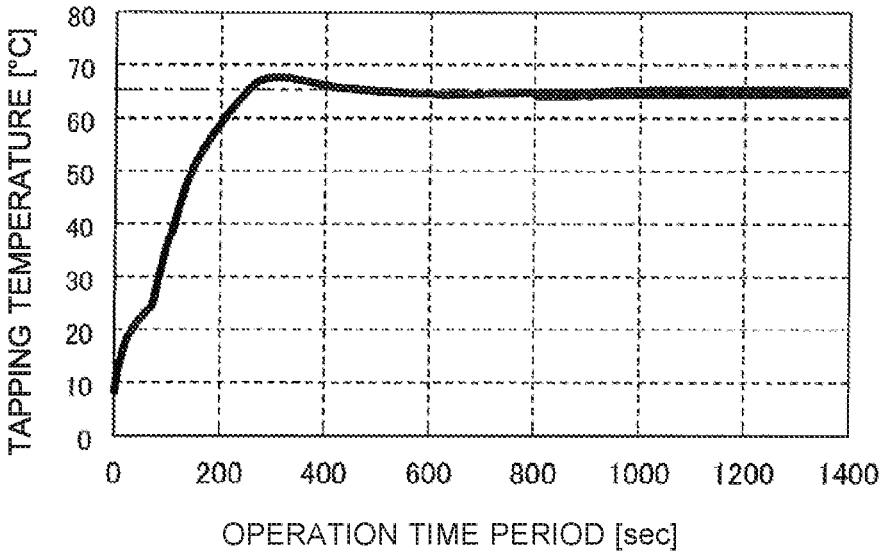
FIG. 4 is a graph for showing a relationship between an operation time period and the tapping temperature of the heat pump cycle in the heat pump hot water supply apparatus according to Embodiment 1 of the present invention.

FIG. 4 is a graph for showing a relationship between an operation time period and the tapping temperature of the heat pump cycle in the heat pump hot water supply apparatus according to Embodiment 1 of the present invention.

The operation time period represented by the horizontal axis in FIG. 4 indicates the operation time period of the heat pump cycle 1. The tapping temperature represented by the vertical axis in FIG. 4 indicates the temperature of the water heated by the gas cooler 3, that is, the temperature of the water flowing through the outflow pipe 23. Further, in FIG. 4, there is shown a relationship between the operation time period and the tapping temperature of the heat pump cycle 1 when the target value of the tapping temperature of the gas cooler 3 is set to 65 degrees Celsius.

As shown in FIG. 4, the heat pump cycle 1 requires a certain time period until the water can be heated up to the target value by the gas cooler 3. In the case of FIG. 4, about 4 minutes are required until the water can be heated up to the target value by the gas cooler 3. This tendency similarly applies to the hot water direct supply operation in which the target value of the tapping temperature of the gas cooler 3 is low. For example, in JIS C 9220, as a calculation condition of an annual performance factor of hot water supply (APF) of the heat pump hot water supply apparatus, the hot water filling flow rate is defined to be from 10 L/min to 15 L/min, and the bath hot water amount is defined to be 180 L. When the hot water is to be filled in the bath 80 under this condition, about 12 minutes to 18 minutes are required to fill the bath 80 with the hot water. When about 4 minutes are required until the water can be heated up to the target value by the gas cooler 3, water having a lower temperature than the target value is supplied to the bath 80 for a time period that is 20% to 30% of the hot water filling time period.

In view of the above, in the heat pump hot water supply apparatus 100 according to Embodiment 1, when a command of the hot water direct supply operation such as a hot water filling command is received from a remote controller (not shown) or other devices, switching to a hot water direct supply operation preparation mode is performed prior to the hot water direct supply operation mode. The switching of the operation mode is performed by the switching section 52.

In this case, the hot water direct supply operation preparation mode corresponds to a first operation mode of the present invention. The hot water direct supply operation mode corresponds to a second operation mode of the present invention.

(Hot Water Direct Supply Operation Preparation Mode)

Figure 5:
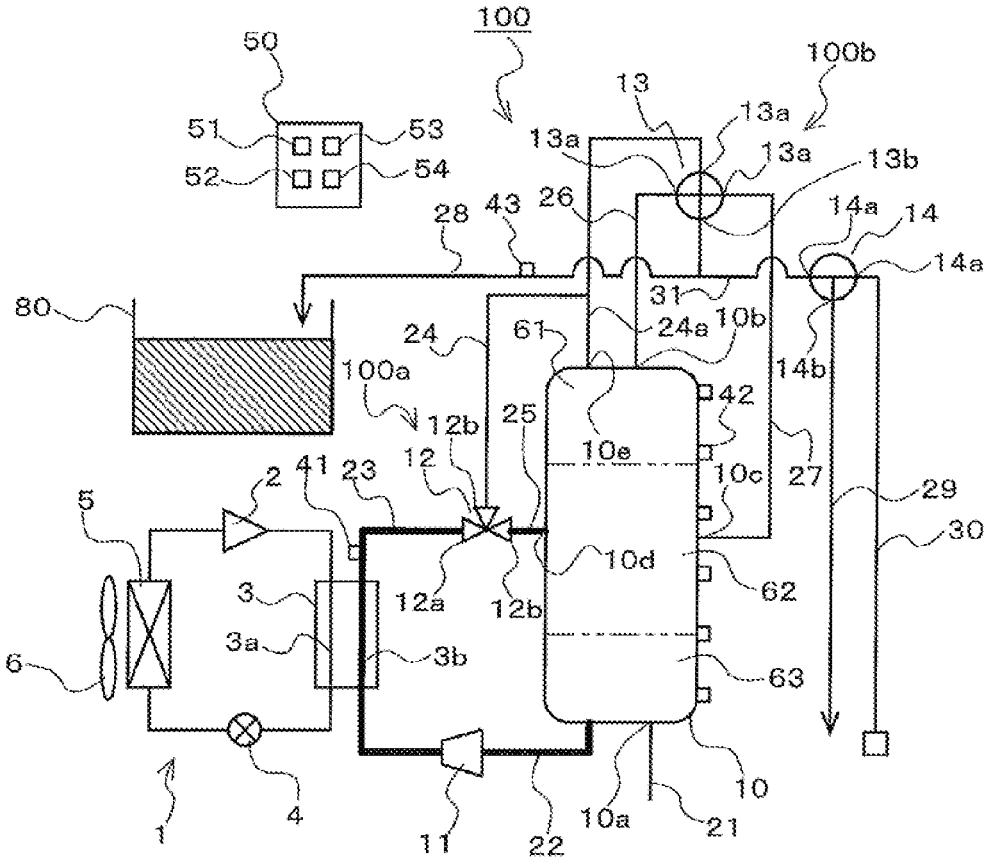
FIG. 5 is a diagram for illustrating an operation of a hot water direct supply operation preparation mode of the heat pump hot water supply apparatus according to Embodiment 1 of the present invention.

FIG. 5 is a diagram for illustrating an operation of the hot water direct supply operation preparation mode of the heat pump hot water supply apparatus according to Embodiment 1 of the present invention.

The hot water direct supply operation preparation mode of Embodiment 1 is an operation mode of causing the water heated in the water flow passage 3*b* of the gas cooler 3 to return to the water tank 10 by the flow switching portion 100*a*. That is, the hot water direct supply operation preparation mode is an operation of heating the water flowing into the water flow passage 3*b* of the gas cooler 3 from the water tank 10 through the inflow pipe 22, and causing the heated water to return to the water tank 10 through the outflow pipe 23, the flow switching device 12, and the branch pipe 25.

Specifically, when the hot water direct supply operation preparation mode is started, the control section 54 switches the flow passages of the flow switching device 12 so that the water flowing in through the inflow port 12*a* flows out through the outflow port 12*b* connected to the branch pipe 25, that is, so that the outflow pipe 23 and the branch pipe 25 are communicated with each other. Then, the control section 54 activates the heat pump cycle 1 and the pump 11 to start the hot water direct supply operation preparation mode.

The operation of the heat pump cycle 1 is basically the same as in the hot water storage operation mode. The control section 54 controls the rotation frequency of the compressor 2, the opening degree of the expansion valve 4, and the rotation frequency of the fan 6 so that the condensing temperature of the refrigerant becomes equal to the target temperature. The target value of the condensing temperature is a value higher by a predefined temperature than the target value of the tapping temperature of the gas cooler 3 during the hot water direct supply operation preparation mode. The target value of the condensing temperature and the target value of the tapping temperature of the gas cooler 3 during the hot water direct supply operation preparation mode are stored in the storage section 51. The target value of the tapping temperature of the gas cooler 3 during the hot water direct supply operation preparation mode is described later.

Meanwhile, in the flow passage through which the water flows, when the pump 11 is activated, the water at the lower portion of the water tank 10, that is, the low-temperature water 63 passes through the inflow pipe 22 to flow into the water flow passage 3*b* of the gas cooler 3. The water flowing into the water flow passage 3*b* of the gas cooler 3 is heated by the refrigerant passing through the refrigerant flow passage 3*a*, and flows into the outflow pipe 23. At this time, the control section 54 controls the rotation frequency of the pump 11 so that the tapping temperature of the gas cooler 3 becomes equal to the target value of the tapping temperature of the gas cooler 3 during the hot water direct supply operation preparation mode. In other words, the control section 54 controls the rotation frequency of the pump 11 so that the temperature of the water flowing into the outflow pipe 23, that is, the measurement value of the temperature sensor 41 becomes equal to the target value of the tapping temperature of the gas cooler 3 during the hot water direct supply operation preparation mode.

The hot water direct supply operation preparation mode is an operation to be performed until the water can be heated up to the target value by the gas cooler 3, that is, until the heat pump cycle 1 is stabilized. For this reason, the water flowing into the outflow pipe 23 has a temperature lower than the target value of the tapping temperature of the gas cooler 3 during the hot water direct supply operation preparation mode. The water passes through the flow switching device 12 and the branch pipe 25 to flow into the water tank 10. Consequently, at the stage of the hot water direct supply operation preparation mode, the amount of the intermediate-temperature water 62 in the water tank 10 is temporarily increased.

The target value of the tapping temperature of the gas cooler 3 during the hot water direct supply operation preparation mode is described. This target value also is the target value of the tapping temperature of the gas cooler 3 during the hot water direct supply operation.

Figure 6:
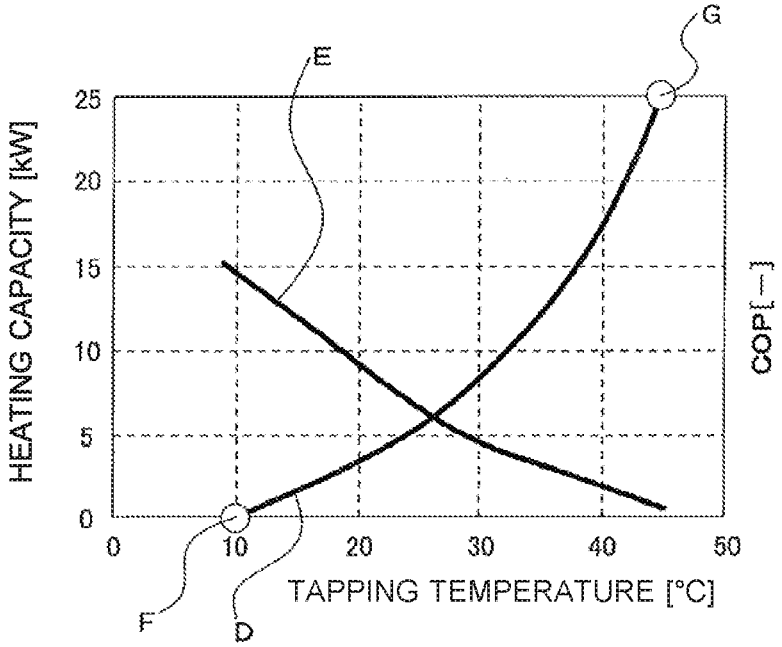
FIG. 6 is a graph for showing a relationship between the tapping temperature and the COP of the heat pump cycle when the hot water is filled through a hot water direct supply operation in the heat pump hot water supply apparatus according to Embodiment 1 of the present invention.

FIG. 6 is a graph for showing a relationship between the tapping temperature and the COP of the heat pump cycle when the hot water is filled through the hot water direct supply operation in the heat pump hot water supply apparatus according to Embodiment 1 of the present invention. The tapping temperature represented by the horizontal axis in FIG. 6 indicates the temperature of the water heated by the gas cooler 3, that is, the temperature of the water flowing through the outflow pipe 23. The vertical axis on the left side in FIG. 6 indicates the heating capacity of the heat pump cycle 1. The vertical axis on the right side in FIG. 6 indicates the COP of the heat pump cycle 1. Further, the curved line D shown in FIG. 6 indicates the characteristic of the heating capacity of the heat pump cycle 1 when the hot water direct supply operation is performed at the time of filling the bath 80 with the hot water. The curved line E shown in FIG. 6 indicates the characteristic of the COP of the heat pump cycle 1. Further, the point F in FIG. 6 indicates a state in which the hot water direct supply operation is not performed at the time of filling the bath 80 with the hot water. That is, the point F in FIG. 6 indicates a state in which the water heated by the gas cooler 3 is not directly supplied to the bath 80, and only the water in the water tank 10 is supplied to the bath 80. Further, the point G in FIG. 6 indicates a state in which the hot water is filled only through the hot water direct supply operation. That is, a part between the point F and the point G indicates a state in which the water heated by the gas cooler 3 is mixed with the water in the water tank 10, and the mixed water is supplied to the bath 80.

As indicated by the curved line D, it is found that, as the tapping temperature is increased, the heating capacity of the heat pump cycle 1 when the hot water direct supply operation is performed is also increased. Further, as indicated by the curved line E, it is found that, as the tapping temperature is increased, the COP of the heat pump cycle 1 is reduced.

That is, it is found preferable that, when the hot water is filled through the hot water direct supply operation, the water heated by the gas cooler 3 be mixed with the water in the water tank 10 and supplied to the bath 80.

Figure 7:
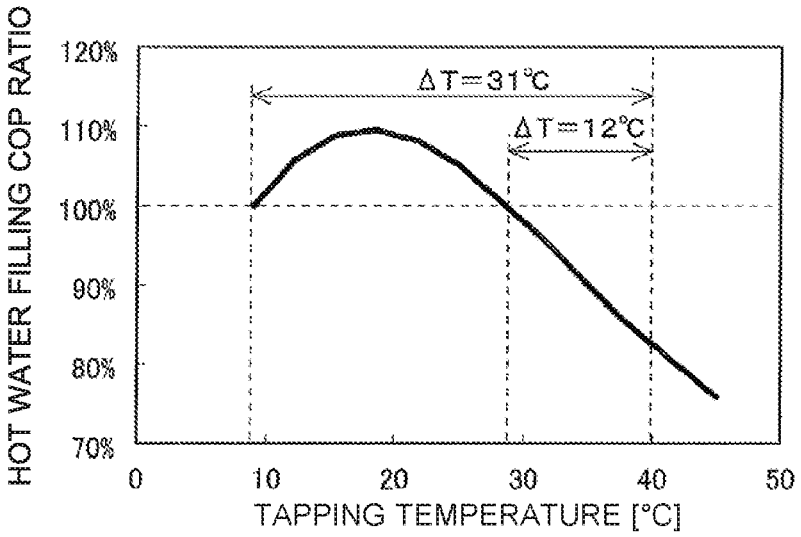
FIG. 7 is a graph for showing a relationship between the tapping temperature and a hot water filling COP ratio of the heat pump cycle when the hot water is filled through the hot water direct supply operation in the heat pump hot water supply apparatus according to Embodiment 1 of the present invention.

FIG. 7 is a graph for showing a relationship between the tapping temperature and a hot water filling COP ratio of the heat pump cycle when the hot water is filled through the hot water direct supply operation in the heat pump hot water supply apparatus according to Embodiment 1 of the present invention.

In FIG. 7, there is shown the COP of the heat pump cycle 1 when the water at 40 degrees Celsius, that is, the hot water to be used for filling the bath 80 with the hot water is generated (hereinafter referred to as hot water filling COP). Further, in FIG. 7, there is shown the hot water filling COP ratio when the hot water filling COP in a case in which the hot water is filled only by the water in the water tank 10 is defined as 100% as a reference. That is, the curved line in FIG. 7 indicates the hot water filling COP when the water heated up to each tapping temperature indicated on the horizontal axis in the gas cooler 3 is mixed with the water in the water tank 10, and the water at 40 degrees Celsius is filled in the bath 80.

The curved line in FIG. 7 is determined by the following expression.

Hot Water Filling COP={Hot Water Storage Operation Mode COP×Tank Heat Amount+Hot Water Direct Supply Mode COP×(1−Activation Loss Ratio)×(Necessary Heat Amount−Tank Heat Amount)}/Necessary Heat Amount In this expression, the hot water storage operation mode COP is a COP of the heat pump cycle 1 when the hot water storage operation is performed. The tank heat amount is a heat amount of the water flowing out from an inside of the water tank 10 at the time of filling the bath 80 with the hot water. The hot water direct supply mode COP is a COP of the heat pump cycle 1 when the water is heated up to each tapping temperature indicated on the horizontal axis in the gas cooler 3. The activation loss ratio is a parameter for considering an energy loss until the heat pump cycle 1 is stabilized when the water is heated up to each tapping temperature indicated on the horizontal axis in the gas cooler 3. The necessary heat amount is a heat amount necessary for filling the bath 80 with the hot water, that is, a heat amount of the water to be supplied to the bath 80.

As shown in FIG. 7, the hot water filling COP when the water heated by the gas cooler 3 is mixed with the water in the water tank 10, and the hot water is filled in a range of a tapping temperature lower than 40 degrees Celsius that is the set temperature of the water to be supplied to the bath 80 by 12 degrees Celsius to 31 degrees Celsius is improved as compared to the hot water filling COP when the hot water is filled only by the water in the water tank 10. The tapping temperature leading to such a relationship of the hot water filling COP differs depending on the temperature of the water caused to flow out from the water tank 10 for the filling of the bath 80 with the hot water or other factors. However, as long as the hot water is filled in a range of a tapping temperature lower than 40 degrees Celsius that is the set temperature of the water to be supplied to the bath 80 by 10 degrees Celsius to 30 degrees Celsius, such a relationship of the hot water filling COP is established regardless of the temperature of the water caused to flow out from the water tank 10 for the filling of the bath 80 with the hot water or other factors.

Consequently, in Embodiment 1, the target value of the tapping temperature of the gas cooler 3 during the hot water direct supply operation preparation mode, that is, the target value of the tapping temperature of the gas cooler 3 during the hot water direct supply operation is set to a temperature lower than the set temperature of the water to be supplied to the bath 80 by a predefined temperature ΔT. The predefined temperature ΔT is, for example, 10 degrees Celsius to 30 degrees Celsius.

(Hot Water Direct Supply Operation Mode)

The hot water direct supply operation mode is an operation mode to be performed after the hot water direct supply operation preparation mode.

In the hot water direct supply operation preparation mode, when the tapping temperature of the gas cooler 3 reaches the target value of the tapping temperature of the gas cooler 3 during the hot water direct supply operation preparation mode, that is, when the tapping temperature of the gas cooler 3 reaches a target value of the tapping temperature of the gas cooler 3 during the hot water direct supply operation mode, the operation mode is switched to the hot water direct supply operation mode. That is, the switching section 52 switches the operation mode from the hot water direct supply operation preparation mode to the hot water direct supply operation mode when the measurement value of the temperature sensor 41 reaches the target value of the tapping temperature of the gas cooler 3 during the hot water direct supply operation mode.

The hot water direct supply operation mode is an operation mode of causing, by the flow switching portion 100*a*, the water heated in the water flow passage 3*b* of the gas cooler 3 to flow to the mixing portion 100*b*, mixing, by the mixing portion 100*b*, the water supplied from the flow switching portion 100*a* with at least the water supplied from the outflow port 10*c* of the water tank 10, and allowing the mixed water to flow to the bath 80, which is the utilization side. Specifically, the hot water direct supply operation mode is an operation of heating the water flowing into the water flow passage 3*b* of the gas cooler 3 from the water tank 10 through the inflow pipe 22 to have a temperature lower than that during the hot water storage operation mode, and causing the heated water to pass through the outflow pipe 23, the flow switching device 12, the branch pipe 24, the connection pipe 24*a*, and the mixing device 13 and to flow out through the outflow port 13*b* of the mixing device 13. That is, the hot water direct supply operation mode is an operation of heating the water flowing into the water flow passage 3*b* of the gas cooler 3 from the water tank 10 through the inflow pipe 22 to have a temperature lower than that during the hot water storage operation mode, and directly supplying the heated water to the bath 80. Further, in the hot water direct supply operation mode of Embodiment 1, in the mixing device 13, the water flowing in from the connection pipe 24*a* is mixed with the intermediate-temperature water 62 flowing in from the connection pipe 27, and the mixed water flows out through the outflow port 13*b* of the mixing device 13.

The heat pump hot water supply apparatus 100 according to Embodiment 1 is configured to execute two hot water direct supply operation modes 1 and 2 as the hot water direct supply operation mode. These hot water direct supply operation modes are selectively used depending on the temperature of the intermediate-temperature water 62, that is, the temperature of the water flowing out through the outflow port 10*c* of the water tank 10. Specifically, at the completion of the hot water direct supply operation preparation mode, the computing section 53 determines the temperature of the intermediate-temperature water 62 flowing out through the outflow port 10*c* of the water tank 10, that is, the temperature of the water flowing through the connection pipe 27 on the basis of the measurement values of the temperature sensors 42. When the temperature of the water flowing through the connection pipe 27 is higher than the set temperature of the water to be supplied to the bath 80, the control section 54 uses the hot water direct supply operation mode 1. On the other hand, when the temperature of the water flowing through the connection pipe 27 is equal to or lower than the set temperature of the water to be supplied to the bath 80, the control section 54 uses the hot water direct supply operation mode 2.

(Hot Water Direct Supply Operation Mode 1)

Figure 8:
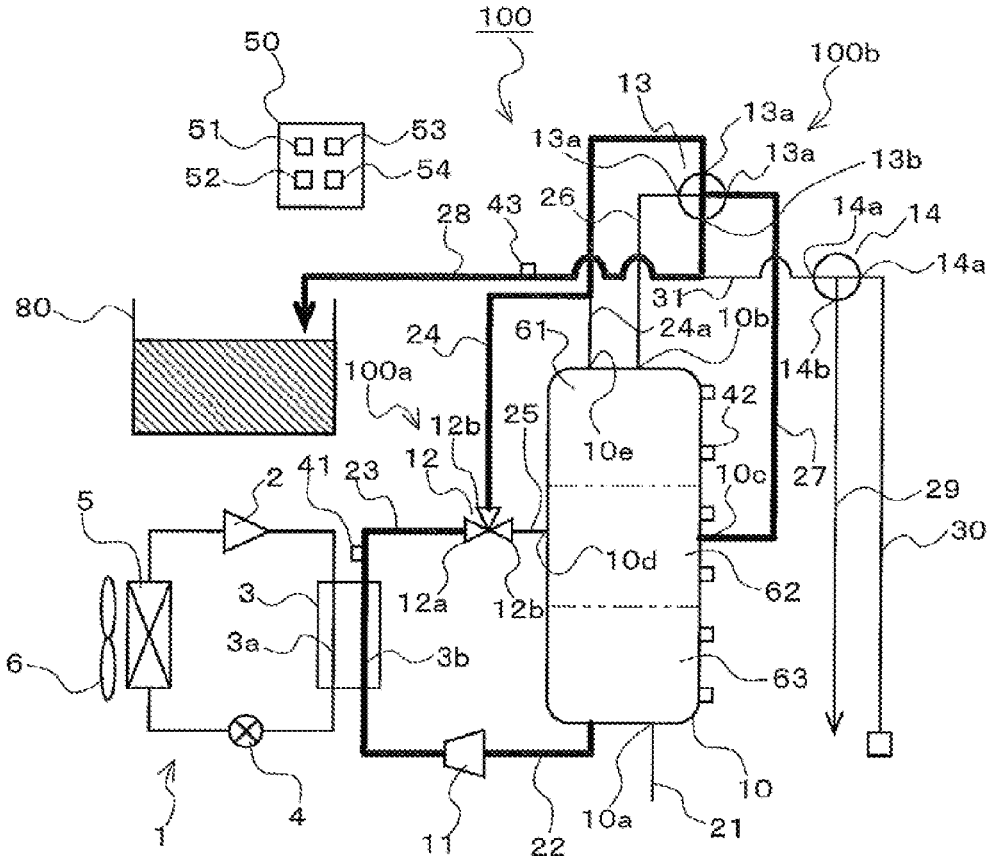
FIG. 8 is a diagram for illustrating an operation of a hot water direct supply operation mode 1 of the heat pump hot water supply apparatus according to Embodiment 1 of the present invention.

FIG. 8 is a diagram for illustrating an operation of the hot water direct supply operation mode 1 of the heat pump hot water supply apparatus according to Embodiment 1 of the present invention.

When the hot water direct supply operation preparation mode is switched to the hot water direct supply operation mode, the computing section 53 determines the temperature of the intermediate-temperature water 62 flowing out through the outflow port 10*c* of the water tank 10, that is, the temperature of the water flowing through the connection pipe 27 on the basis of the measurement values of the temperature sensors 42. When the temperature of the water flowing through the connection pipe 27 is higher than the set temperature of the water to be supplied to the bath 80, the control section 54 uses the hot water direct supply operation mode 1. Consequently, the control section 54 controls the flow switching portion 100*a* and the mixing portion 100*b* as follows. Specifically, the control section 54 switches the flow passages of the flow switching device 12 so that the water flowing in through the inflow port 12*a* flows out through the outflow port 12*b* connected to the branch pipe 24, that is, so that the outflow pipe 23 and the branch pipe 24 are communicated with each other. Further, the computing section 53 computes an opening degree of the inflow port 13*a* connected to the connection pipe 24*a* and an opening degree of the inflow port 13*a* connected to the connection pipe 27 on the basis of a temperature of the water flowing through the connection pipe 24*a*, that is, the measurement value of the temperature sensor 41 and the temperature of the water flowing through the connection pipe 27. That is, the computing section 53 calculates a mixing ratio between the water flowing out from the connection pipe 24*a* and the intermediate-temperature water 62 flowing out from the connection pipe 27. Then, the control section 54 controls the mixing device 13 so that the opening degree of the inflow port 13*a* connected to the connection pipe 24*a* and the opening degree of the inflow port 13*a* connected to the connection pipe 27 become equal to the opening degrees determined by the computing section 53. With this operation, the water is supplied to the bath 80 by flowing as follows. An operation of the heat pump cycle 1 is the same as that in the hot water direct supply operation preparation mode.

That is, the water at the lower portion of the water tank 10, that is, the low-temperature water 63 passes through the inflow pipe 22 to flow into the water flow passage 3*b* of the gas cooler 3. The water flowing into the water flow passage 3*b* of the gas cooler 3 is heated by the refrigerant passing through the refrigerant flow passage 3*a*, and flows into the outflow pipe 23. At this time, the control section 54 controls the rotation frequency of the pump 11 so that the tapping temperature of the gas cooler 3 becomes equal to the target value of the tapping temperature of the gas cooler 3 during the hot water direct supply operation mode. In other words, the control section 54 controls the rotation frequency of the pump 11 so that the temperature of the water flowing into the outflow pipe 23, that is, the measurement value of the temperature sensor 41 becomes equal to the target value of the tapping temperature of the gas cooler 3 during the hot water direct supply operation mode.

The water flowing into the outflow pipe 23 passes through the flow switching device 12, the branch pipe 24, and the connection pipe 24*a* to flow into the mixing device 13. Meanwhile, the intermediate-temperature water 62 in the water tank 10 passes through the connection pipe 27 to flow into the mixing device 13. Then, the water flowing into the mixing device 13 from the connection pipe 24*a* is mixed with the intermediate-temperature water 62 flowing into the mixing device 13 from the connection pipe 27 in the mixing device 13 to have a temperature equal to the set temperature of the water to be supplied to the bath 80, and the mixed water flows out through the outflow port 13*b*.

The heat pump hot water supply apparatus 100 according to Embodiment 1 includes a temperature sensor 43 configured to measure a temperature of the water flowing through the hot water supply pipe 28, that is, measure a temperature of the water flowing out through the outflow port 13*b* of the mixing device 13. Consequently, the control section 54 also performs feedback control of the mixing device 13 on the basis of a measurement value of the temperature sensor 43. That is, the control section 54 controls the opening degree of the inflow port 13*a* connected to the connection pipe 24*a* and the opening degree of the inflow port 13*a* connected to the connection pipe 27 so that the measurement value of the temperature sensor 43 becomes equal to the set temperature of the water to be supplied to the bath 80.

(Hot Water Direct Supply Operation Mode 2)

Figure 9:
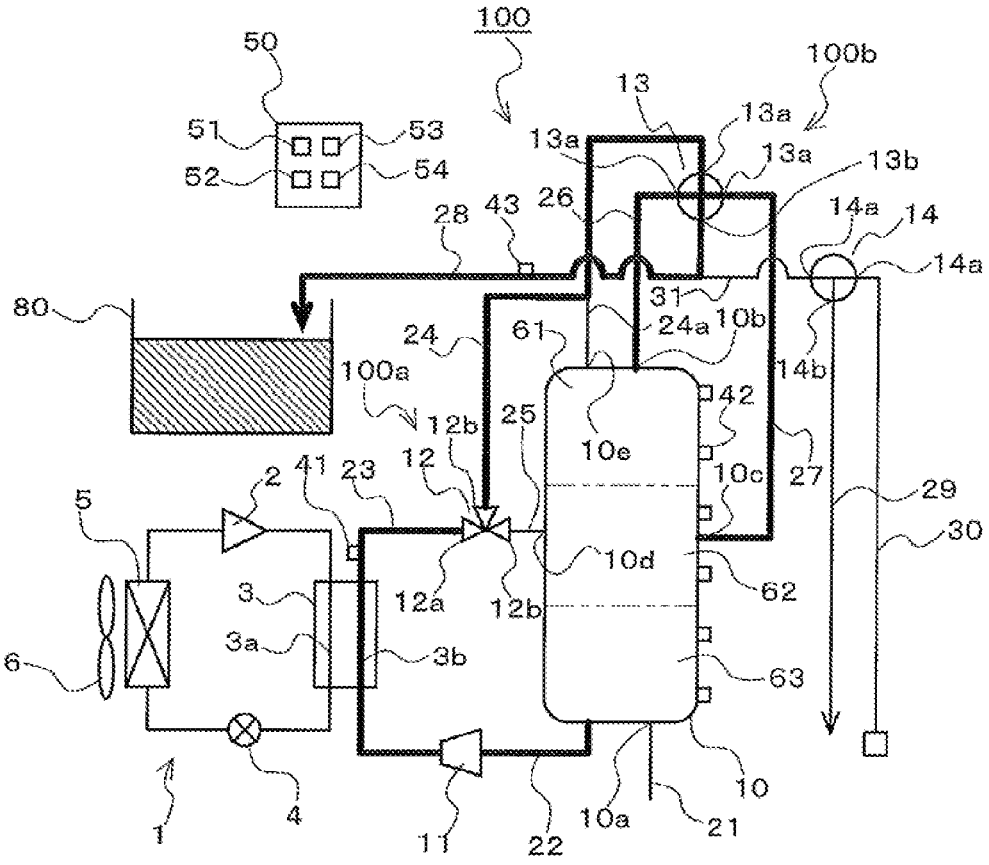
FIG. 9 is a diagram for illustrating an operation of a hot water direct supply operation mode 2 of the heat pump hot water supply apparatus according to Embodiment 1 of the present invention.

FIG. 9 is a diagram for illustrating an operation of the hot water direct supply operation mode 2 of the heat pump hot water supply apparatus according to Embodiment 1 of the present invention.

When the hot water direct supply operation preparation mode is switched to the hot water direct supply operation mode, the computing section 53 determines the temperature of the intermediate-temperature water 62 flowing out through the outflow port 10*c* of the water tank 10, that is, the temperature of the water flowing through the connection pipe 27 on the basis of the measurement values of the temperature sensors 42. When the temperature of the water flowing through the connection pipe 27 is equal to or lower than the set temperature of the water to be supplied to the bath 80, the control section 54 uses the hot water direct supply operation mode 2. Consequently, the control section 54 controls the flow switching portion 100*a* and the mixing portion 100*b* as follows. Specifically, the control section 54 switches the flow passages of the flow switching device 12 so that the water flowing in through the inflow port 12*a* flows out through the outflow port 12*b* connected to the branch pipe 24, that is, so that the outflow pipe 23 and the branch pipe 24 are communicated with each other. Further, the computing section 53 computes the opening degree of the inflow port 13*a* connected to the connection pipe 24*a*, the opening degree of the inflow port 13*a* connected to the connection pipe 27, and an opening degree of the inflow port

13*a* connected to the connection pipe 26 on the basis of the temperature of the water flowing from the connection pipe 24*a*, that is, the measurement value of the temperature sensor 41, the temperature of the water flowing through the connection pipe 27, and a temperature of the water flowing through the connection pipe 26. That is, the computing section 53 calculates a mixing ratio of the water flowing out from the connection pipe 24*a*, the intermediate-temperature water 62 flowing out from the connection pipe 27, and the high-temperature water 61 flowing out from the connection pipe 26. Then, the control section 54 controls the mixing device 13 so that the opening degree of the inflow port 13*a* connected to the connection pipe 24*a*, the opening degree of the inflow port 13*a* connected to the connection pipe 27, and the opening degree of the inflow port 13*a* connected to the connection pipe 26 become equal to the opening degrees determined by the computing section 53. With this operation, the water is supplied to the bath 80 by flowing as follows. An operation of the heat pump cycle 1 is the same as that in the hot water direct supply operation preparation mode. Further, the temperature of the water flowing through the connection pipe 26 is determined by the computing section 53 on the basis of the measurement values of the temperature sensors 42.

That is, the water at the lower portion of the water tank 10, that is, the low-temperature water 63 passes through the inflow pipe 22 to flow into the water flow passage 3*b* of the gas cooler 3. The water flowing into the water flow passage 3*b* of the gas cooler 3 is heated by the refrigerant passing through the refrigerant flow passage 3*a*, and flows into the outflow pipe 23. At this time, the control section 54 controls the rotation frequency of the pump 11 so that the tapping temperature of the gas cooler 3 becomes equal to the target value of the tapping temperature of the gas cooler 3 during the hot water direct supply operation mode. In other words, the control section 54 controls the rotation frequency of the pump 11 so that the temperature of the water flowing into the outflow pipe 23, that is, the measurement value of the temperature sensor 41 becomes equal to the target value of the tapping temperature of the gas cooler 3 during the hot water direct supply operation mode.

The water flowing into the outflow pipe 23 passes through the flow switching device 12, the branch pipe 24, and the connection pipe 24*a* to flow into the mixing device 13. Meanwhile, the intermediate-temperature water 62 in the water tank 10 passes through the connection pipe 27 to flow into the mixing device 13. Further, the high-temperature water 61 in the water tank 10 passes through the connection pipe 26 to flow into the mixing device 13. Then, the water flowing into the mixing device 13 from the connection pipe 24*a*, the intermediate-temperature water 62 flowing into the mixing device 13 from the connection pipe 27, and the high-temperature water 61 flowing into the mixing device 13 from the connection pipe 26 are mixed with each other in the mixing device 13 to have a temperature equal to the set temperature of the water to be supplied to the bath 80, and the mixed water flows out through the outflow port 13*b*. That is, in the hot water direct supply operation mode 2 in which the temperature of the intermediate-temperature water 62 flowing into the mixing device 13 is equal to or lower than the set temperature of the water to be supplied to the bath 80, the high-temperature water 61 is also mixed by the mixing device 13, thereby preventing the temperature of the water to be supplied to the bath 80 from being lower than the set temperature.

The heat pump hot water supply apparatus 100 according to Embodiment 1 includes the temperature sensor 43 configured to measure the temperature of the water flowing through the hot water supply pipe 28, that is, measure the temperature of the water flowing out through the outflow port 13*b* of the mixing device 13. Consequently, the control section 54 also performs feedback control of the mixing device 13 on the basis of the measurement value of the temperature sensor 43. That is, the control section 54 controls the opening degree of the inflow port 13*a* connected to the connection pipe 24*a*, the opening degree of the inflow port 13*a* connected to the connection pipe 27, and the opening degree of the inflow port 13*a* connected to the connection pipe 26 so that the measurement value of the temperature sensor 43 becomes equal to the set temperature of the water to be supplied to the bath 80.

As described above, the heat pump hot water supply apparatus 100 according to Embodiment 1 operates in the hot water direct supply operation preparation mode before the hot water direct supply operation. Then, in the hot water direct supply operation preparation mode, the water heated by the gas cooler 3 is caused to return to the water tank 10. Consequently, when the heat pump hot water supply apparatus 100 according to Embodiment 1 supplies the water flowing out through the outflow port 13*b* of the mixing device 13 to the bath 80 to fill the bath 80 with the hot water, the low-temperature water given immediately after the activation of the heat pump cycle 1 can be prevented from being supplied to the bath 80. In this case, in the heat pump hot water supply apparatus 100 according to Embodiment 1, the temperature of the water heated by the gas cooler 3 during the hot water direct supply operation mode is lower than the set temperature of the water flowing out through the outflow port 13*b* of the mixing device 13, that is, the temperature of the hot water in the bath 80. However, in the heat pump hot water supply apparatus 100 according to Embodiment 1, in the mixing device 13, the water heated by the gas cooler 3 is mixed with at least the intermediate-temperature water 62 flowing in from the connection pipe 27, and the mixed water flows out through the outflow port 13*b*. That is, the water heated by the gas cooler 3 can be mixed with the intermediate-temperature water 62 in the water tank 10, and the mixed water can be supplied to the bath 80.

Consequently, in the heat pump hot water supply apparatus 100 according to Embodiment 1, the temperature of the hot water in the bath 80 can be prevented from being lower than the set temperature when the hot water is filled in the hot water direct supply operation mode.

Further, in the heat pump hot water supply apparatus 100 according to Embodiment 1, as described above, the water heated by the gas cooler 3 can be mixed with the intermediate-temperature water 62 in the water tank 10, and the mixed water can be supplied to the bath 80. Consequently, in the heat pump hot water supply apparatus 100 according to Embodiment 1, increase of the amount of the intermediate-temperature water 62 in the water tank 10 can be prevented, thereby being also capable of improving the COP of the heat pump cycle 1 during the hot water storage operation. Further, as described above, in the heat pump hot water supply apparatus 100 according to Embodiment 1, the temperature of the water heated by the gas cooler 3 during the hot water direct supply operation mode is lower than the set temperature of the water flowing out through the outflow port 13*b* of the mixing device 13, that is, the temperature of the hot water in the bath 80. For this reason, the COP of the heat pump cycle 1 during the hot water direct supply operation mode can further be improved.

Consequently, the heat pump hot water supply apparatus 100 according to Embodiment 1 can improve the COP of the heat pump cycle 1 as compared to the related art.

Embodiment 2

A heat pump hot water supply apparatus 100 according to Embodiment 2 is different from the heat pump hot water supply apparatus 100 according to Embodiment 1 in that a hot water direct supply operation mode 3 is used in place of the hot water direct supply operation mode 2 described in Embodiment 1. Further, as the heat pump hot water supply apparatus 100 according to Embodiment 2 uses the hot water direct supply operation mode 3, a hot water direct supply operation preparation mode is also different from that of Embodiment 1.

In the following, the hot water supply operation preparation mode and the hot water direct supply operation mode 3 of the heat pump hot water supply apparatus 100 according to Embodiment 2 are described. In Embodiment 2, matters that are not particularly described are the same as those of Embodiment 1, and the same functions and configurations are described such that the same reference signs are denoted.

(Hot Water Direct Supply Operation Preparation Mode)

The hot water direct supply operation preparation mode of Embodiment 2 is the same as that of Embodiment 1 until the tapping temperature of the gas cooler 3 reaches the target value of the tapping temperature of the gas cooler 3 during the hot water direct supply operation preparation mode. In the hot water direct supply operation preparation mode of Embodiment 2, when the tapping temperature of the gas cooler 3 reaches the target value of the tapping temperature of the gas cooler 3 during the hot water direct supply operation preparation mode, the computing section 53 determines the temperature of the intermediate-temperature water 62 flowing out through the outflow port 10*c* of the water tank 10, that is, the temperature of the water flowing through the connection pipe 27 on the basis of the measurement values of the temperature sensors 42. When the temperature of the water flowing through the connection pipe 27 is higher than the set temperature of the water to be supplied to the bath 80, the control section 54 performs the hot water direct supply operation using the hot water direct supply operation mode 1 similarly to Embodiment 1.

In contrast, when the temperature of the water flowing through the connection pipe 27 is equal to or lower than the set temperature of the water to be supplied to the bath 80, the control section 54 replaces the target value of the tapping temperature of the gas cooler 3 during the hot water direct supply operation preparation mode, that is, the target value of the tapping temperature of the gas cooler 3 during the hot water direct supply operation to a temperature higher by a predefined temperature than the set temperature of the water to be supplied to the bath 80. Then, the control section 54 continues the hot water direct supply operation preparation mode until the tapping temperature of the gas cooler 3 reaches the replaced new target value. Subsequently, when a measurement value of the temperature sensor 41 reaches the replaced new target value, the switching section 52 switches the operation mode from the hot water direct supply operation preparation mode to the hot water direct supply operation mode 3.

(Hot Water Direct Supply Operation Mode 3)

A flow passage through which the water flows in the hot water direct supply operation mode 3 is the same as that in the hot water direct supply operation mode 1 illustrated in FIG. 8. In Embodiment 1, when the temperature of the water flowing through the connection pipe 27 is equal to or lower than the set temperature of the water to be supplied to the bath 80, that is, when the temperature of the intermediate-temperature water 62 flowing into the mixing device 13 is equal to or lower than the set temperature of the water to be supplied to the bath 80, the high-temperature water 61 is also mixed by the mixing device 13, thereby preventing the temperature of the water to be supplied to the bath 80 from being lower than the set temperature (see the hot water direct supply operation mode 2). In contrast, in the hot water direct supply operation mode 3 of Embodiment 2, when the temperature of the intermediate-temperature water 62 flowing into the mixing device 13 is equal to or lower than the set temperature of the water to be supplied to the bath 80, the temperature of the water flowing into the mixing device 13 from the connection pipe 24*a* is set to a temperature higher by a predefined temperature than the set temperature of the water to be supplied to the bath 80, thereby preventing the temperature of the water to be supplied to the bath 80 from being lower than the set temperature.

As described above, also in the heat pump hot water supply apparatus 100 according to Embodiment 2, the low-temperature water given immediately after the activation of the heat pump cycle 1 can be prevented from being supplied to the bath 80. Further, in the hot water direct supply operation mode, the intermediate-temperature water 62 in the water tank 10 is used, thereby being capable of preventing the increase of the amount of the intermediate-temperature water 62 in the water tank 10. Consequently, in the heat pump hot water supply apparatus 100 according to Embodiment 2, similarly to Embodiment 1, the temperature of the hot water in the bath 80 can be prevented from being lower than the set temperature when the hot water is filled in the hot water direct supply operation mode, thereby being also capable of improving the COP of the heat pump cycle 1.

Embodiment 3

A heat pump hot water supply apparatus 100 according to Embodiment 3 is different from the heat pump hot water supply apparatus 100 according to Embodiment 1 in that a hot water direct supply operation mode 4 is used as the hot water direct supply operation mode.

In the following, the hot water direct supply operation mode 4 of the heat pump hot water supply apparatus 100 according to Embodiment 3 is described. In Embodiment 3, matters that are not particularly described are the same as those of Embodiment 1, and the same functions and configurations are described such that the same reference signs are denoted.

(Hot Water Direct Supply Operation Mode 4)

A flow passage through which the water flows in the hot water direct supply operation mode 4 is the same as that in the hot water direct supply operation mode 2 illustrated in FIG. 9. In Embodiment 1, when the temperature of the water flowing through the connection pipe 27 is higher than the set temperature of the water to be supplied to the bath 80, that is, when the temperature of the intermediate-temperature water 62 flowing into the mixing device 13 is higher than the set temperature of the water to be supplied to the bath 80, the hot water direct supply operation mode 1 is used. Further, in Embodiment 1, when the temperature of the water flowing through the connection pipe 27 is equal to or lower than the set temperature of the water to be supplied to the bath 80, that is, when the temperature of the intermediate-temperature water 62 flowing into the mixing device 13 is equal to or lower than the set temperature of the water to be supplied to the bath 80, the hot water direct supply operation mode 2 is used. In contrast, the heat pump hot water supply apparatus 100 according to Embodiment 3 uses the hot water direct supply operation mode 4 regardless of the temperature of the water flowing through the connection pipe 27, that is, the temperature of the intermediate-temperature water 62 flowing into the mixing device 13.

Also in the heat pump hot water supply apparatus 100 according to Embodiment 3, the low-temperature water given immediately after the activation of the heat pump cycle 1 can be prevented from being supplied to the bath 80. Further, in the hot water direct supply operation mode, the intermediate-temperature water 62 in the water tank 10 is used, thereby being capable of preventing the increase of the amount of the intermediate-temperature water 62 in the water tank 10. Consequently, in the heat pump hot water supply apparatus 100 according to Embodiment 3, similarly to Embodiment 1, the temperature of the hot water in the bath 80 can be prevented from being lower than the set temperature when the hot water is filled in the hot water direct supply operation mode, thereby being also capable of improving the COP of the heat pump cycle 1.

Further, in the heat pump hot water supply apparatus 100 according to Embodiment 3, the high-temperature water 61 is mixed by the mixing device 13 without fail during the hot water direct supply operation. For this reason, in the heat pump hot water supply apparatus 100 according to Embodiment 3, during the hot water direct supply operation, the temperature of the water to be supplied to the bath 80 does not become lower than the set temperature regardless of the temperature of the intermediate-temperature water 62 flowing into the mixing device 13. Consequently, in the heat pump hot water supply apparatus 100 according to Embodiment 3, when the feedback control of the mixing device 13 is performed on the basis of the measurement value of the temperature sensor 43, it is not necessary to measure the temperature of the intermediate-temperature water 62 flowing into the mixing device 13, and the temperature sensors necessary for determining the temperature of the intermediate-temperature water 62 flowing into the mixing device 13 become unnecessary. For this reason, the heat pump hot water supply apparatus 100 according to Embodiment 3 can also obtain an effect of being capable of manufacturing the heat pump hot water supply apparatus 100 inexpensively as compared to the heat pump hot water supply apparatus 100 according to Embodiments 1 and 2.

Embodiment 4

The flow switching device 12 of Embodiment 1 to Embodiment 3 may be constructed as follows. In Embodiment 4, matters that are not particularly described are the same as those of any of Embodiments 1 to 3, and the same functions and configurations are described such that the same reference signs are denoted.

Figure 10:
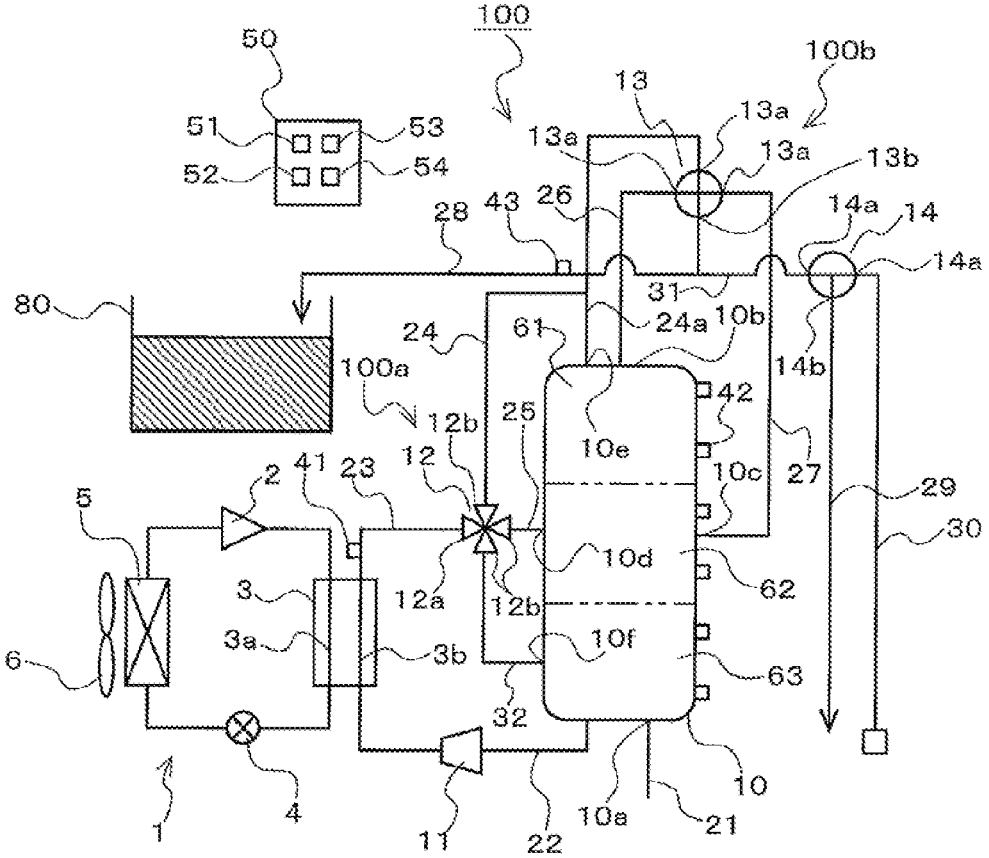
FIG. 10 is an overall configuration diagram of a heat pump hot water supply apparatus according to Embodiment 4 of the present invention.

FIG. 10 is an overall configuration diagram of a heat pump hot water supply apparatus according to Embodiment 4 of the present invention.

The water tank 10 of the heat pump hot water supply apparatus 100 according to Embodiment 4 includes a return port 10*f*. The return port 10*f* is provided below the return port 10*d*. For example, the return port 10*d* is connected to the vicinity of the lower portion of the water tank 10. Further, the flow switching device 12 of the heat pump hot water supply apparatus 100 according to Embodiment 4 includes three outflow ports 12*b*, which are obtained by adding one outflow port 12*b* to the two outflow ports 12*b* of Embodiments 1 to 3. In Embodiment 4, the flow switching device 12 is constructed by, for example, a four-way valve. The flow switching device 12 is not limited to the four-way valve, and, for example, may be constructed by combining two-way valves.

A first end portion of a branch pipe 32 is connected to the above-mentioned added outflow port 12*b*. A second end portion of the branch pipe 32 is connected to the return port 10*f* of the water tank 10.

In this case, the return port 10*d* corresponds to a second return port of the present invention.

The heat pump hot water supply apparatus 100 according to Embodiment 4 constructed as described above operates as follows in the hot water direct supply operation preparation mode.

Figure 11:
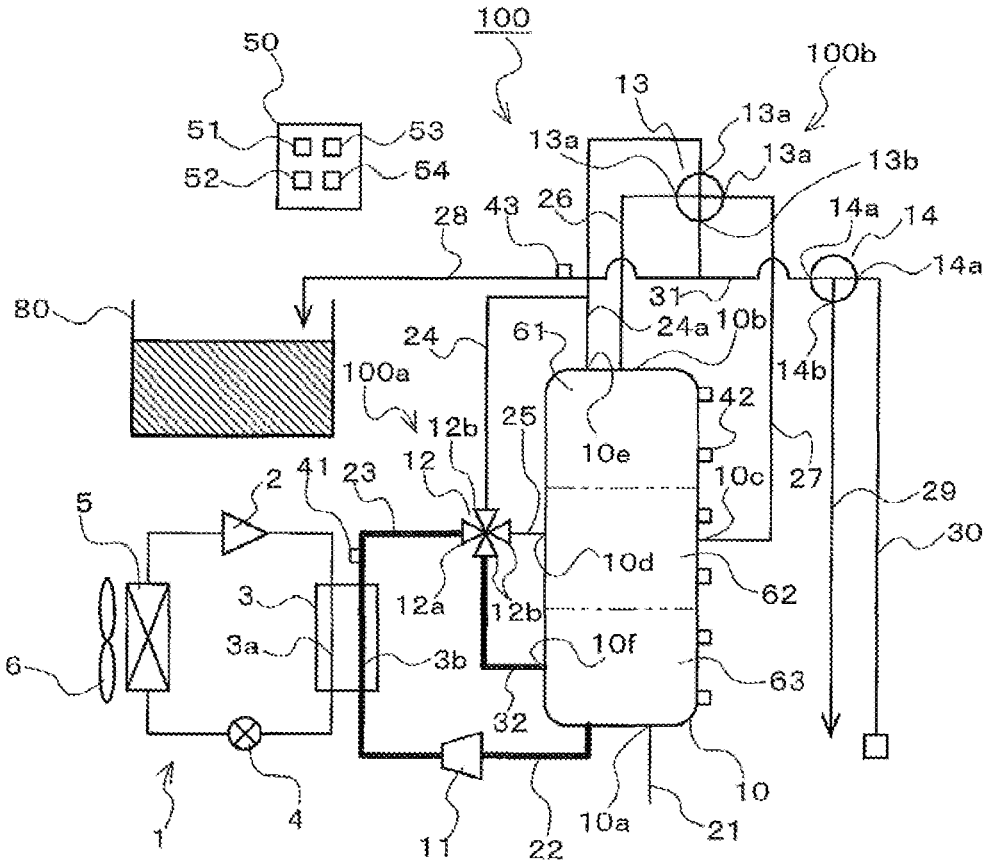
FIG. 11 is a diagram for illustrating an operation of the hot water direct supply operation preparation mode of the heat pump hot water supply apparatus according to Embodiment 4 of the present invention.
Figure 12:
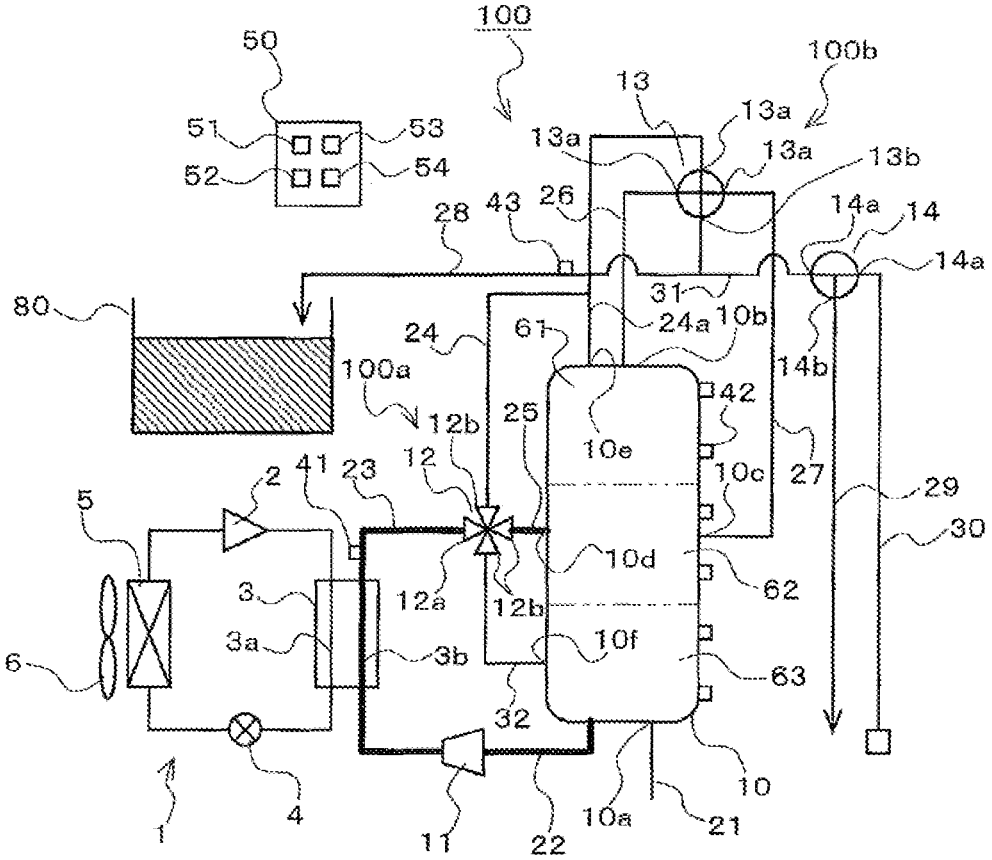
FIG. 12 is a diagram for illustrating the operation of the hot water direct supply operation preparation mode of the heat pump hot water supply apparatus according to Embodiment 4 of the present invention.

FIG. 11 and FIG. 12 are diagrams for illustrating an operation of a hot water direct supply operation preparation mode of the heat pump hot water supply apparatus according to Embodiment 4 of the present invention.

In the hot water direct supply operation preparation mode of Embodiment 4, the water flowing into the water flow passage 3*b* of the gas cooler 3 from the water tank 10 through the inflow pipe 22 is heated, and the heated water is caused to flow into the flow switching device 12 through the outflow pipe 23. The operation up to this point is the same as those of Embodiment 1 to Embodiment 3. The hot water direct supply operation preparation mode of Embodiment 4 is different from those of Embodiment 1 to Embodiment 3 in the following matter. The water flowing into the flow switching device 12 is caused to return to the water tank 10 first through the branch pipe 32, in other words, through the return port 10*f*. Subsequently, the water flowing into the flow switching device 12 is caused to return to the water tank 10 through the branch pipe 25, in other words, through the return port 10*d*.

Specifically, when the hot water direct supply operation preparation mode is started, the control section 54 switches the flow passages of the flow switching device 12 as illustrated in FIG. 11. That is, the control section 54 switches the flow passages of the flow switching device 12 so that the water flowing in through the inflow port 12*a* flows out through the outflow port 12*b* connected to the branch pipe 32, that is, so that the outflow pipe 23 and the branch pipe 32 are communicated with each other.

When the tapping temperature of the gas cooler 3 reaches a switching temperature, that is, when the measurement value of the temperature sensor 41 reaches the switching temperature, as illustrated in FIG. 12, the control section 54 switches the flow passages of the flow switching device 12. That is, the control section 54 switches the flow passages of the flow switching device 12 so that the water flowing in through the inflow port 12*a* flows out through the outflow port 12*b* connected to the branch pipe 25, that is, so that the outflow pipe 23 and the branch pipe 25 are communicated with each other. The subsequent operations are the same as those in Embodiment 1 to Embodiment 3. The switching temperature is, for example, a fixed value, and is stored in the storage section 51. Further, the computing section 53 may obtain a temperature of the water in the vicinity of the connected position between the water tank 10 and the branch pipe 25 on the basis of the measurement values of the temperature sensors 42, and the computing section 53 may determine the switching temperature on the basis of the temperature of the water. For example, the temperature of the water in the vicinity of the connected position between the water tank 10 and the branch pipe 25 may be used as the switching temperature.

The hot water direct supply operation preparation mode is performed until the operation of the heat pump cycle 1 is stabilized. Consequently, the water flowing into the flow switching device 12 at an early stage of the hot water direct supply operation preparation mode is low-temperature water that is close in temperature to the low-temperature water 63 supplied from the water tank 10 to the gas cooler 3. Then, as the hot water direct supply operation preparation mode is being continued, the temperature of the water flowing into the flow switching device 12 is raised. Through the switching of the flow passages of the flow switching device 12 as described above, the low-temperature water at the early stage of the hot water direct supply operation preparation mode can be caused to flow into the lower side in the water tank 10, that is, a region in which the low-temperature water 63 exists. Then, this low-temperature water at the early stage of the hot water direct supply operation preparation mode can be caused to immediately flow to the gas cooler 3, and be heated. Consequently, the low-temperature water at the early stage of the hot water direct supply operation preparation mode can be prevented from being mixed into the high-temperature water 61 or the intermediate-temperature water 62 in the water tank 10, and thus the increase of the amount of the intermediate-temperature water 62 can be prevented.

REFERENCE SIGNS LIST

1 heat pump cycle 2 compressor 3 gas cooler 3*a* refrigerant flow passage 3*b* water flow passage 4 expansion valve 5 evaporator

6 fan 10 water tank 10*a* inflow port 10*b* outflow port 10*c* outflow port 10*d* return port 10*e* return port 10*f* return port 11 pump 12 flow switching device 12*a* inflow port 12*b* outflow port 13 mixing device

13*a* inflow port 13*b* outflow port 14 mixing device 14*a* inflow port

14*b* outflow port 21 water supply pipe 22 inflow pipe 23 outflow pipe 24 branch pipe 24*a* connection pipe 25 branch pipe 26 connection pipe 27 connection pipe 28 hot water supply pipe 29 hot water supply pipe 30 water supply pipe 31 connection pipe 32 branch pipe 41 temperature sensor 42 temperature sensor 43 temperature sensor 50 controller 51 storage section 52 switching section 53 computing section 54 control section 61 high-temperature water 62 intermediate-temperature water 63 low-temperature water 80 bath 100 heat pump hot water supply apparatus 100*a* flow switching portion 100*b* mixing portion

The invention claimed is:

1. A heat pump hot water supply apparatus, comprising:
a heat pump cycle including a gas cooler heating water;
a water tank including:
an inflow port for water,
a first outflow port for water, the first outflow port being provided above the inflow port, and
a second outflow port for water, the second outflow port being provided above the inflow port and below the first outflow port;
a flow switching portion that switches between the water tank and a utilization side to which the water heated by the gas cooler is allowed to flow; and
a mixing portion provided between the flow switching portion and the utilization side, andthe mixing portion
mixing water supplied from the flow switching portion and water supplied from at least one of the first outflow port or the second outflow port, and
allowing the mixed water to flow to the utilization side,
the heat pump hot water supply apparatus executing operation modes including a first operation mode and a second operation mode to be performed after the first operation mode and to supply water having a set temperature,
the first operation mode including:
causing, by the flow switching portion, the water that was heated by the gas cooler to flow out of the gas cooler and to return to the water tank until temperature of the water that flows out of the gas cooler is lower than the set temperature by a predefined temperature,
the second operation mode including:
causing, by the flow switching portion, the water that was heated by the gas cooler from the water tank to flow to the mixing portion,
mixing, by the mixing portion, the water supplied from the flow switching portion and at least the water supplied from the second outflow port, and
allowing the mixed water to flow to the utilization side in the second operation mode,
in the second operation mode, when a temperature of the water flowing out through the second outflow port is higher than the set temperature, the water supplied from the flow switching portion being mixed with the water supplied from the second outflow port by the mixing portion, and the mixed water being caused to flow to the utilization side.

2. The heat pump hot water supply apparatus of claim 1, wherein, in the second operation mode, the water supplied from the flow switching portion, the water supplied from the first outflow port, and the water supplied from the second outflow port are mixed with each other by the mixing portion, and the mixed water is caused to flow to the utilization side.

3. The heat pump hot water supply apparatus of claim 2, wherein, in the second operation mode, when a temperature of the water flowing out through the second outflow port is equal to or lower than the set temperature, the water supplied from the flow switching portion, the water supplied from the first outflow port, and the water supplied from the second outflow port are mixed with each other by the mixing portion, and the mixed water is caused to flow to the utilization side.

4. The heat pump hot water supply apparatus of claim 1, wherein the first operation mode is switched to the second operation mode after the temperature of the water heated by the gas cooler becomes lower than the set temperature by the predefined temperature.

5. The heat pump hot water supply apparatus of claim 1, wherein, in the second operation mode, when a temperature of the water flowing out through the second outflow port is equal to or lower than a set temperature of water flowing out from the mixing portion, a temperature of the water heated by the gas cooler is higher than the set temperature by a predefined temperature.

6. The heat pump hot water supply apparatus of claim 5, wherein the first operation mode is switched to the second operation mode after the temperature of the water heated by the gas cooler becomes higher than the set temperature by the predefined temperature.

7. The heat pump hot water supply apparatus of claim 1, wherein the water tank includes a first return port and a second return port provided below the first return port, wherein the flow switching portion is connected to the water tank through the first return port and the second return port, and wherein, in the first operation mode, the flow switching portion first causes the water heated by the gas cooler to return to the water tank through the second return port, and then, causes the water to return to the water tank through the first return port.

8. The heat pump hot water supply apparatus of claim 2, further comprising: a first temperature measurement device determining the temperature of the water heated by the gas cooler; and a controller, wherein the controller includes a storage section storing the set temperature of the water flowing out from the mixing portion, a switching section switching an operation mode from the first operation mode to the second operation mode on a basis of a measurement value of the first temperature measurement device, and a control section controlling the flow switching portion and the mixing portion on a basis of the operation mode and the measurement value of the first temperature measurement device.

9. The heat pump hot water supply apparatus of claim 1, further comprising: a first temperature measurement device determining a temperature of the water heated by the gas cooler, a second temperature measurement device determining a temperature of the water flowing out through the second outflow port; and controller, wherein the controller includes a storage section storing a set temperature of water flowing out from the mixing portion, a switching section switching an operation mode from the first operation mode to the second operation mode on a basis of a measurement value of the first temperature measurement device, and a control section controlling the flow switching portion and the mixing portion on a basis of the operation mode, the measurement value of the first temperature measurement device, and a measurement value of the second temperature measurement device.

10. The heat pump hot water supply apparatus of claim 1, wherein the first operation mode is a hot water direct supply operation preparation mode, and the second operation mode is a hot water direct supply operation mode.

* * * * *